US007589624B2

(12) United States Patent
Hatakeyama

(10) Patent No.: US 7,589,624 B2
(45) Date of Patent: Sep. 15, 2009

(54) COMPONENT UNIT MONITORING SYSTEM AND COMPONENT UNIT MONITORING METHOD

(75) Inventor: Kouichi Hatakeyama, Minato-ku (JP)

(73) Assignee: NEC Corporation, Tokyo (JP)

( * ) Notice: Subject to any disclaimer, the term of this patent is extended or adjusted under 35 U.S.C. 154(b) by 283 days.

(21) Appl. No.: 11/260,217

(22) Filed: Oct. 28, 2005

(65) Prior Publication Data

US 2006/0106577 A1 May 18, 2006

(30) Foreign Application Priority Data

Oct. 29, 2004 (JP) ..... 2004-317269

(51) Int. Cl.
*G08B 26/00* (2006.01)

(52) U.S. Cl. ..... 340/505; 340/506; 340/3.1; 340/517; 340/521; 340/825.36; 340/825.49

(58) Field of Classification Search ..... 340/505, 340/506, 3.1, 517, 521, 825.36, 825.49
See application file for complete search history.

(56) References Cited

U.S. PATENT DOCUMENTS

| | | | | |
|---|---|---|---|---|
| 5,400,246 | A * | 3/1995 | Wilson et al. | 700/17 |
| 6,243,010 | B1 * | 6/2001 | Addy et al. | 340/539.16 |
| 2004/0196006 | A1 | 10/2004 | Kawaguchi et al. | |

FOREIGN PATENT DOCUMENTS

| | | | |
|---|---|---|---|
| JP | 61198349 | A | 9/1986 |
| JP | 358245 | A | 3/1991 |
| JP | 5324950 | A | 12/1993 |
| JP | 749727 | A | 2/1995 |
| JP | 798668 | A | 4/1995 |
| JP | 950419 | A | 2/1997 |
| JP | 10-161907 | A | 6/1998 |
| JP | 2000259455 | A | 9/2000 |
| JP | 2001-147909 | A | 5/2001 |
| JP | 2002-288050 | A | 10/2002 |
| JP | 2004-078840 | A | 3/2004 |
| JP | 2004110709 | A | 4/2004 |
| JP | 2004-157715 | A | 6/2004 |
| JP | 2004174115 | A | 6/2004 |
| JP | 2004206677 | A | 7/2004 |
| JP | 2004-232977 | A | 8/2004 |

* cited by examiner

*Primary Examiner*—Daryl C Pope
(74) *Attorney, Agent, or Firm*—Sughrue Mion, PLLC

(57) ABSTRACT

A component unit monitoring system includes at least one independently installable component unit, a system management controller, a wireless transmission and reception controller for controlling communications between the system management controller and a first wireless link, and a wireless IC tag connected to the wireless transmission and reception controller through the first wireless link, for acquiring status information of the component unit. The wireless IC tag sends status information representing an installation history and a status value of the component unit to the system management controller through the first wireless link. The system management controller analyzes the received status information and sends an analytic result through the first wireless link to the wireless IC tag. The wireless IC tag stores the analytic result as a history of chronological data.

13 Claims, 22 Drawing Sheets

COMPONENT UNIT MONITORING SYSTEM AND COMPONENT UNIT MONITORING METHOD

BACKGROUND OF THE INVENTION (1) Field of the Invention

The present invention relates to a component unit monitoring system for monitoring the status of a component unit, and more particularly to a component unit monitoring system for monitoring the status of a component unit using a wireless IC tag.

(2) Description of the Related Art

Heretofore, a server computer holds component unit information and ancillary sensor information as initial information in a NVRAM (NonVolatile RAM) that is inherent to the server computer. When the component unit information is changed, the information stored in the NVRAM needs to be updated to reflect the change. Therefore, it has been tedious and time-consuming to manage the component unit information. For monitoring a sensor attached to a component unit of a server computer, it has been customary to employ a controller known as a BMC (Baseboard Management Controller) for centralized management. The user is naturally unable to access fault information of the sensor unless the server computer is turned on.

On some conventional computer systems, a sensor attached to a component unit is monitored using a BMC as follows: The BMC is connected to devices to be monitored (hereinafter referred to as component units) which are mounted on the computer system by a bus such as an SMBus (System Management Bus). Fault information produced by sensors is generally stored in a memory that is managed by the BMC. Because the fault information from the sensors is stored in the memory associated with the BMC, the user needs dedicated software to read the fault information from the memory. In addition, the user cannot read the stored fault information when the computer system is turned off.

The fault information of various component units is centrally managed by the single BMC. Accordingly, the user is unable to track down records of fault information of individual component units when they are removed from the computer system. For identifying a sensor associated with a component unit in an analysis of fault information managed by the MBC, the user has to acquire necessary information from the NVRAM inherent to the computer system. It has been tedious and time-consuming to manage VNRAM information generated for each of the component units.

Japanese laid-open patent publication No. 2004-078840 discloses a wireless tag and a telemetry system for writing a signal from a sensor into an EEPROM (Electrically Erasable Programmable ROM) in the wireless tag and sending sensor data on a reply frame to an inquiring machine. Although the wireless tag reads the signal from the sensor, sends the signal to the inquiring machine, and stores the signal, the wireless tag does not analyze the signal and does not store analytic results.

Japanese laid-open patent publication No. 2004-157715 discloses a method of generating a database for an electronic apparatus by acquiring component numbers which are assigned to respective components of the electric apparatus and serve as component identification data for identifying the components, from a data acquisition device, and storing the acquired component identification data in association with a manufacturer's serial number as apparatus identification data. According to the disclosed method, although component numbers are acquired and stored, status information of the component is not dynamically grasped.

SUMMARY OF THE INVENTION

It is an object of the present invention to provide a component unit monitoring system which is capable of acquiring status information of component units of a system to be monitored regardless of whether the system is turned on or not.

Another object of the present invention is to provide a component unit monitoring system which is capable of acquiring status information of component units when they are removed from a system to be monitored.

Still another object of the present invention is to provide a component unit monitoring system which is capable of dynamically grasping the configurational information of a system to be monitored.

Technical features of the present invention for achieving the above objects will be described below using reference characters in parentheses that are used in the description of preferred embodiments of the present invention. The reference characters are added herein merely to clarify the correspondence between the description of the scope of claims and the description of the preferred embodiments, and should not be used to interpret the scope of the present invention which is described in the scope of claims.

A component unit monitoring system according to the present invention has at least one independently installable component unit (2), a system management controller (3, 3'), a wireless transmission and reception controller (4) connected to the system management controller (3, 3'), for controlling communications between the system management controller (3, 3') and a first wireless link (7), and a wireless IC tag (1, 1') mounted on the component unit (2), for acquiring status information of the component unit (2), the wireless IC tag (1, 1') being connected to the wireless transmission and reception controller (4) through the first wireless link (7).

The wireless IC tag (1, 1') sends status information representing an installation history, a status value, etc. of the component unit (2) through the first wireless link (7) to the system management controller (3, 3'). The system management controller (3, 3') analyzes the status information received from the wireless IC tag (1, 1') and sends an analytic result through the first wireless link (7) to the wireless IC tag (1, 1'). The wireless IC tag (1, 1') stores the analytic result received from the system management controller (3, 3') as a history of chronological data.

The component unit monitoring system further includes a component control device (20) connected between the component unit (2) and the wireless IC tag (1, 1'). The system management controller (3, 3') sends a first request signal for acquiring the status information of the component unit (2) to the wireless IC tag (1, 1') through the first wireless link (7). The wireless IC tag (1, 1') sends a second request signal to the component control device (20) in response to the first request signal from the system management controller (3, 3'). The component control device (20) acquires the status information from the component unit (2) in response to the second request signal from the wireless IC tag (1, 1') and sends the status information to the wireless IC tag (1, 1'). The wireless IC tag (1, 1') sends the status information received from the component control device (20) to the system management controller (3, 3').

The wireless IC tag (1, 1') has either a power supply (11) for generating electric energy from electromagnetic waves transmitted over a wireless link, or a power supply (11) comprising a cell. Therefore, the system management controller (3, 3') and the wireless IC tag (3, 3') operate on respective different power supplies.

The component unit monitoring system further includes an external wireless module (6) for acquiring configurational information from the system management controller (3, 3') or the wireless IC tag (1, 1') through a second wireless link (7).

The system management controller (3, 3') of the component unit monitoring system according to the present invention is thus capable of dynamically identifying component units. When the system management controller (3, 3') detects a fault, the system management controller (3, 3') controls the wireless transmission and reception controller (4) to store fault information into wireless IC tag (1, 1'). When the component unit monitoring system is serviced for maintenance, the external wireless module (6) may be used to analyze fault information or identify a faulty component unit regardless whether the system connected to the component unit or the faulty component unit (2) is turned on or off.

As described above, the component unit monitoring system according to the present invention is capable of acquiring status information of a component unit of a system to be monitored regardless of whether the system is turned on or off.

The component unit monitoring system is also capable of acquiring status information of a component unit removed from a computer system.

Furthermore, the component unit monitoring system is capable of dynamically grasping the configurational information of a system to be monitored.

The above and other objects, features, and advantages of the present invention will become apparent from the following description with reference to the accompanying drawings which illustrate examples of the present invention.

DESCRIPTION OF THE PREFERRED EMBODIMENTS

As smaller wireless IC (Integrated Circuit) tags are available in the art, it has become possible to install those wireless IC tags on component units mounted in one housing or component units that are connected to a computer system by cables. A wireless IC tag installed on a system may be energized by a power supply which is different from the power supply of the computer system. A component unit monitoring system according to the present invention is preferably used to monitor the statuses of component units in a computer system, e.g., faults which have occurred in the component units or an installation history of the component units in the computer system.

1st Embodiment

A component unit monitoring system according to a first embodiment of the present invention will be described below with reference to FIGS. 1 through 16.

The component unit monitoring system serves to monitor the status information of component units, e.g., a motherboard in a computer, a DIMM (Dual-In-line Memory Module) on the motherboard, a cooling fan (hereinafter referred to as "FAN"), a CPU, etc., of a server computer system used in a server. The status information comprises configurational information representing the manner in which the component units are mounted in the computer system and fault information representing faults of the component units.

Figure 1:
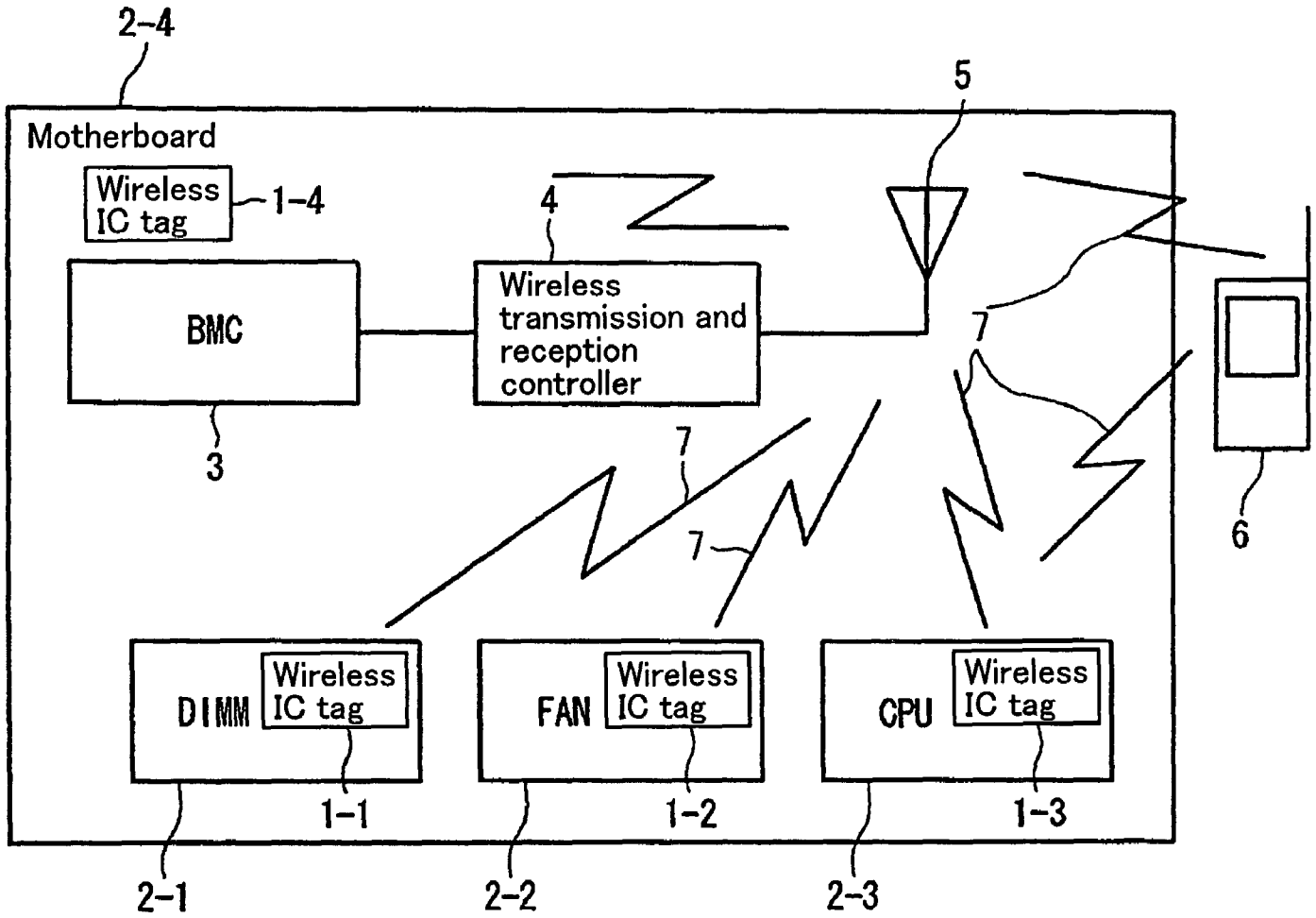
FIG. 1 is a block diagram of a component unit monitoring system according to a first embodiment of the present invention.

FIG. 1 shows in block form the component unit monitoring system according to the first embodiment of the present invention. As shown in FIG. 1, the component unit monitoring system comprises BMC (Baseboard Management Controller) 3 serving as a system management controller, component units including DIMM 2-1, FAN 2-2, CPU 2-3, and motherboard 2-4, and wireless transmission and reception controller 4 connected to BMC 3. BMC 3, the component units excluding motherboard 2-4, and wireless transmission and reception controller 4 are mounted on motherboard 2-4 which is connected to a computer system. The component unit monitoring system also includes wireless IC tags 1-1 through 1-4 connected to the respective component units. The component unit monitoring system further has external wireless module 6 for connecting a circuit outside of the computer system through wireless links 7 to wireless transmission and reception controller 4 and wireless IC tags 1-1 through 1-4. The component units including DIMM 2-1, FAN 2-2, CPU 2-3, and motherboard 2-4 will also be collectively referred to as "component unit 2", and wireless IC tags 1-1 through 1-4 connected to the respective component units will also be collectively referred to as "wireless IC tag 1".

Wireless IC tag 1 is connected to wireless transmission and reception controller 4 through wireless links 7, and is controlled by BMC 3 to acquire status information of component unit 2. Wireless transmission and reception controller 4 and antenna 5 connected thereto are mounted on motherboard 2-4. However, wireless transmission and reception controller 4 and antenna 5 are not limited to being mounted on motherboard 2-4, but may be positioned anywhere insofar as they can be connected to wireless IC tag 1 through wireless links 7. Component unit 2 is not limited to DIMM 2-1, FAN 2-2, CPU 2-3, and motherboard 2-4 either, but may be an external storage unit, a monitor, a printer, etc. connected through various I/Fs insofar as it is part of the computer system.

According to the first embodiment, wireless IC tag 1 comprises a passive wireless IC tag which is energized by electric energy received from wireless transmission and reception controller 4 or external wireless module 6 through wireless link 7. Wireless transmission and reception controller 4 and external wireless module 6 operate on the multiple access principles to communicate with all wireless IC tags 1 in the computer system. BMC 3 and external wireless module 6 are capable of selectively controlling wireless IC tags 1 to obtain status information therefrom by inserting GUIDs (Global Unique Identifiers) of wireless IC tags 1 into data transmitted to wireless IC tags 1.

Figure 2:
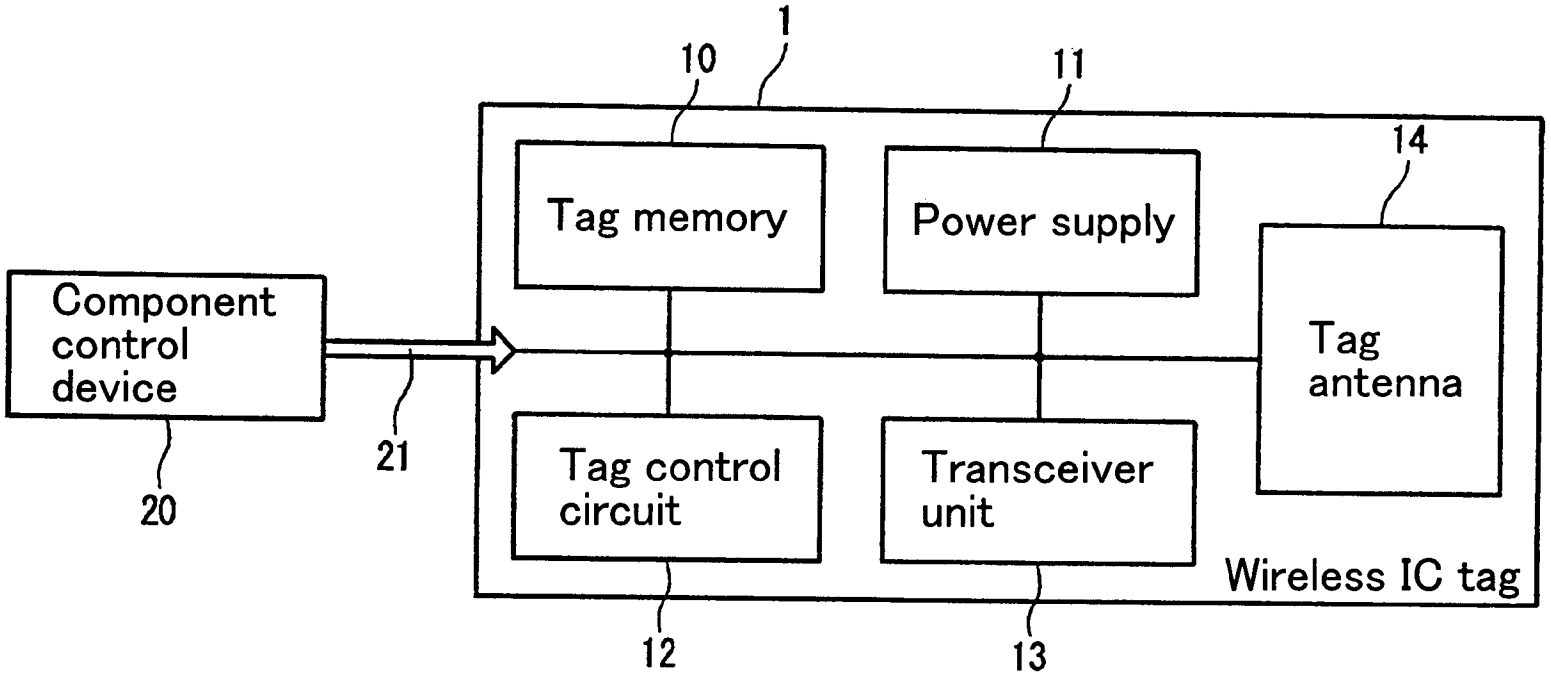
FIG. 2 is a block diagram of a wireless IC tag used in the component unit monitoring system according to the first embodiment of the present invention.

FIG. 2 shows wireless IC tag 1 in block form. As shown in FIG. 2, wireless IC tag 1 has tag memory 10, power supply 11, tag control circuit 12, transceiver unit 13, and tag antenna 14 which are connected to each other by a bus.

Tag memory 10 comprises a read-write memory capable of reading data therefrom and writing data therein, and has a memory map. Various information generated by tag control circuit 12 is stored in the memory map.

Figure 7:
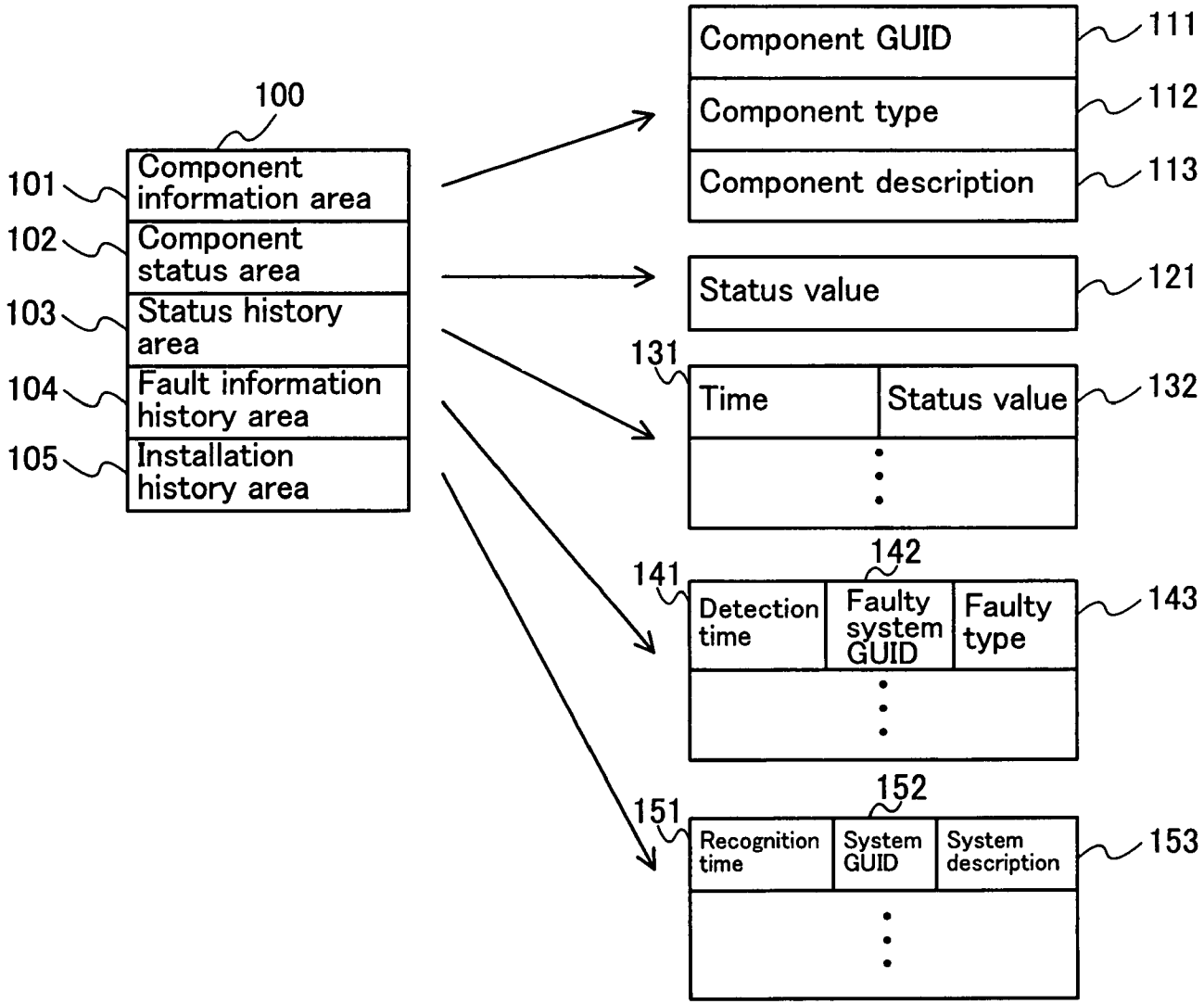
FIG. 7 is a diagram showing a memory map held by the wireless IC tag used in the component unit monitoring system according to the first embodiment of the present invention.

FIG. 7 shows details of memory map 100. As shown in FIG. 7, memory map 100 has component information area 101, component status area 102, status history area 103, fault information history area 104, and installation history area 105.

Component information area 101 stores component information inherent to component unit 2 on which wireless IC tag 1 is mounted. The component information includes component GUID 111 for identifying component unit 2, component type 112 representing the name and type of component unit 2, and component description 113 including specifications and version information of component unit 2. A sufficiently large value represented by about 2 to the 128th power is assigned to component GUID 111, so that component GUID 111 can uniquely identify a component unit. Component type 112 is used to identify the type of a component such as a CPU, a DIMM, a FAN, etc. Component description 113 represents information for describing features of a component unit, and may have any format. The component information is initially written in component information area 101.

Component status area 102 stores status value 121 representing the present status of component unit 2. Status value 121 represents information obtained from status signal 21 (see FIG. 2) that is supplied from component control device 20. For example, status value 121 indicates the temperature or voltage of component unit 2, or the rotational speed of FAN 2-2.

Status history area 103 stores a history of chronological data representing successive status values 121 from component status area 102 as status values 132 at respective times 131. Fault information history area 104 is an area for storing fault information representative of faults that occurred in component unit 2 on which wireless IC tag 1 is mounted. Specifically, fault information history area 104 stores a history of chronological data representing successive times 141 at which faults were detected on component unit 2, faulty system GUIDs 142 representing identifiers of computer systems connected to component unit 2 which was faulty, and faulty types 143.

Installation history area 105 is an area for storing a history of system information of computer systems which were connected to component unit 2 on which wireless IC tag 1 is mounted. Specifically, installation history area 105 stores a history of chronological data representing successive recognition times 151 at which component unit 2 was recognized as a new unit, system GUIDs 152 representing identifiers of computer systems connected to component unit 2, and system description 153 representing specifications and version information of those computer systems. Based on the installation system information stored in installation history area 105, it is possible to track down computer systems to which component unit 2 was connected.

Wireless IC tag 1 communicates with wireless transmission and reception controller 4 and external wireless module 6 through tag antenna 14. In wireless IC tag 1, which is a passive wireless IC tag, power supply 11 generates electric energy based on electromagnetic waves transmitted from wireless transmission and reception controller 4 and external wireless module 6, and tag control circuit 12 and transceiver unit 13 operates based on the electric energy supplied from power supply 11.

Tag control circuit 12 controls signals and data in wireless IC tag 1. In response to a request for status information from BMC 3, tag control circuit 12 sends a request signal for requesting status signal 21 from component control device 20 to acquire status information of component unit 2. Transceiver unit 13, which serves to input and output signals and data through tag antenna 14, receives status signal 21 from component control device 20. Transceiver unit 13 also modulates and demodulates signals and data that are input and output through tag antenna 14.

Figure 3:
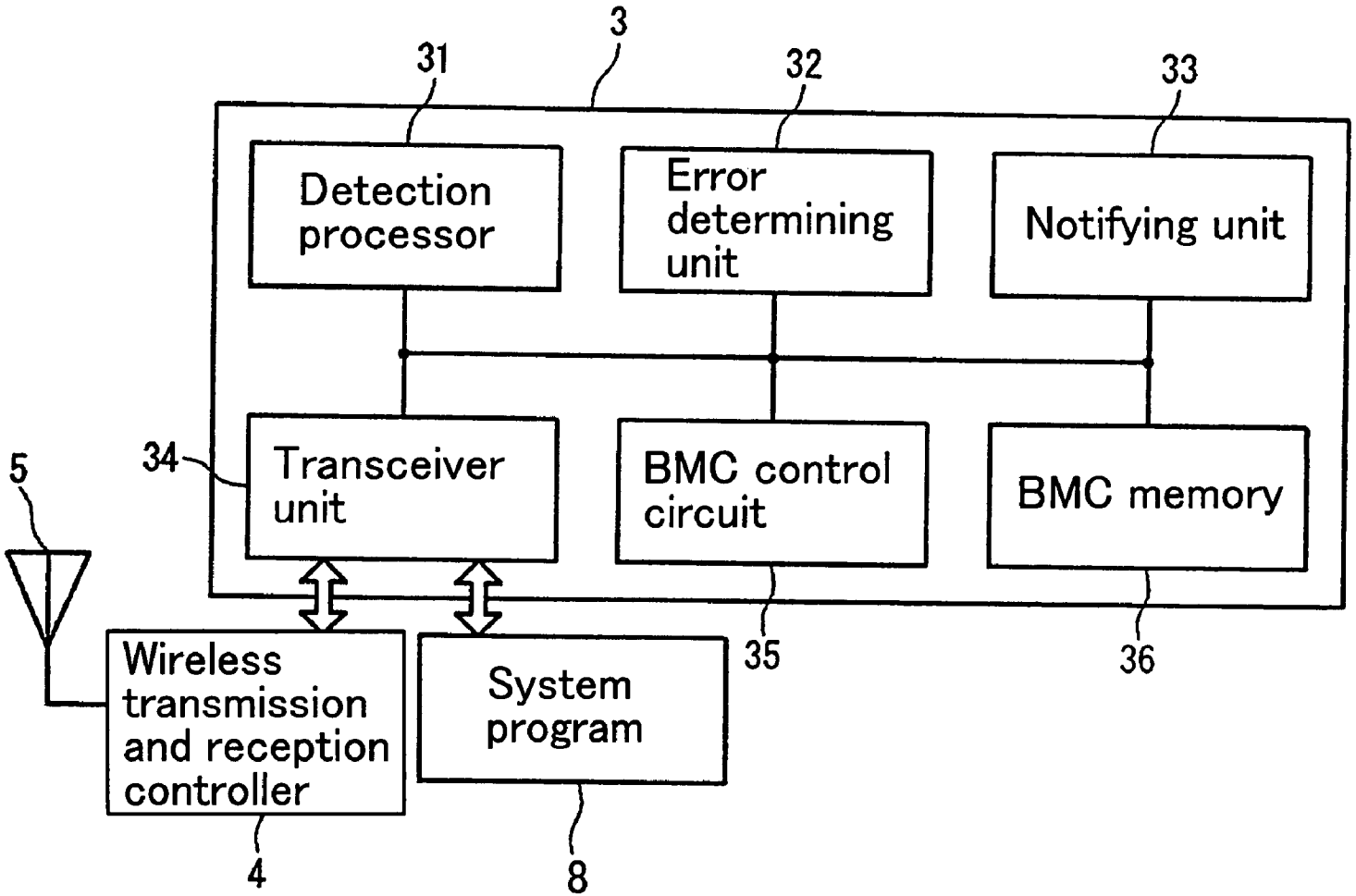
FIG. 3 is a block diagram of a BMC used in the component unit monitoring system according to the first embodiment of the present invention.

FIG. 3 shows details of BMC 3 in block form. As shown in FIG. 3, BMC 3 has detection processor 31, error determining unit 32, notifying unit 33, transceiver unit 34, BMC control circuit 35, and BMC memory 36 which are connected to each other by a communication bus.

Transceiver unit 34 is connected to wireless transmission and reception controller 4 through motherboard 2-4. Transceiver unit 34 controls wireless transmission and reception controller 4 to communicate with wireless IC tags 1 and external wireless module 6 through antenna 5. BMC 3 is controlled by a program such as an OS of the computer system through motherboard 2-4.

Detection processor 31 analyzes data supplied from wireless IC tag 1 and determines whether component unit 2 connected to the computer system is a new component unit or not. If detection processor 31 judges that component unit 2 connected to the computer system is a new component unit, then detection processor 31 requests component information from wireless IC tag 1 and stores the component information received from wireless IC tag 1 as component configurational information in BMC memory 36 which is an internal memory of BMC 3.

Figure 8:
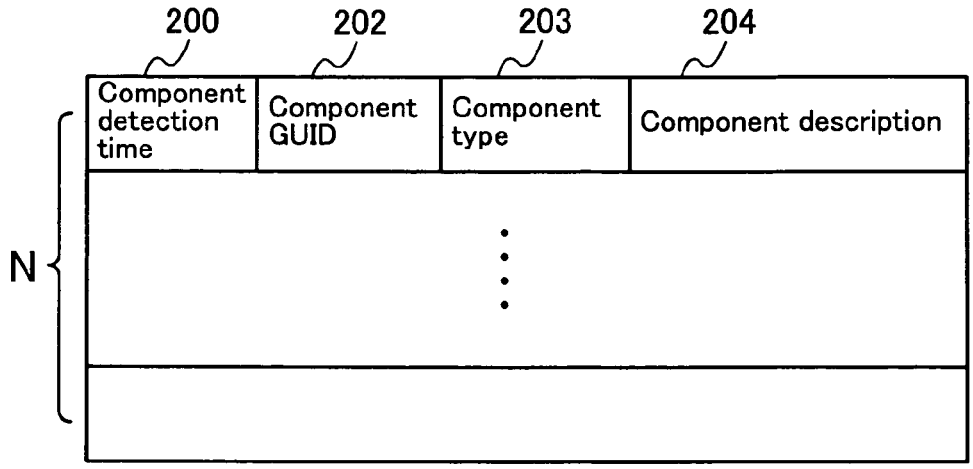
FIG. 8 is a diagram showing component configurational information stored in a BMC memory.

FIG. 8 shows details of component configurational information stored in BMC memory 36. As shown in FIG. 8, the component configurational information comprises as many items of information as component units 2 detected by detection processor 31, each including component detection time 200 at which component unit 2 was detected, component GUID 202 corresponding to component information, component type 203, and component description 204.

Error determining unit 32 analyzes data supplied from wireless IC tag 1, determines whether component unit 2 has suffered a fault or not, and transmits the determined result through wireless link 7 to wireless IC tag 1. When requested by a program of the computer system, i.e., system program 8, or external wireless module 6, notifying unit 33 notifies system program 8 or external wireless module 6 of the component configurational information stored in BMC memory 36.

BMC control circuit 35 controls signals and data in BMC 3 and also controls operation of detection processor 31, error determining unit 32, and notifying unit 33. Transceiver unit 34 controls various signals and data that are input and output between wireless transmission and reception controller 4 and system program 8.

Figure 4:
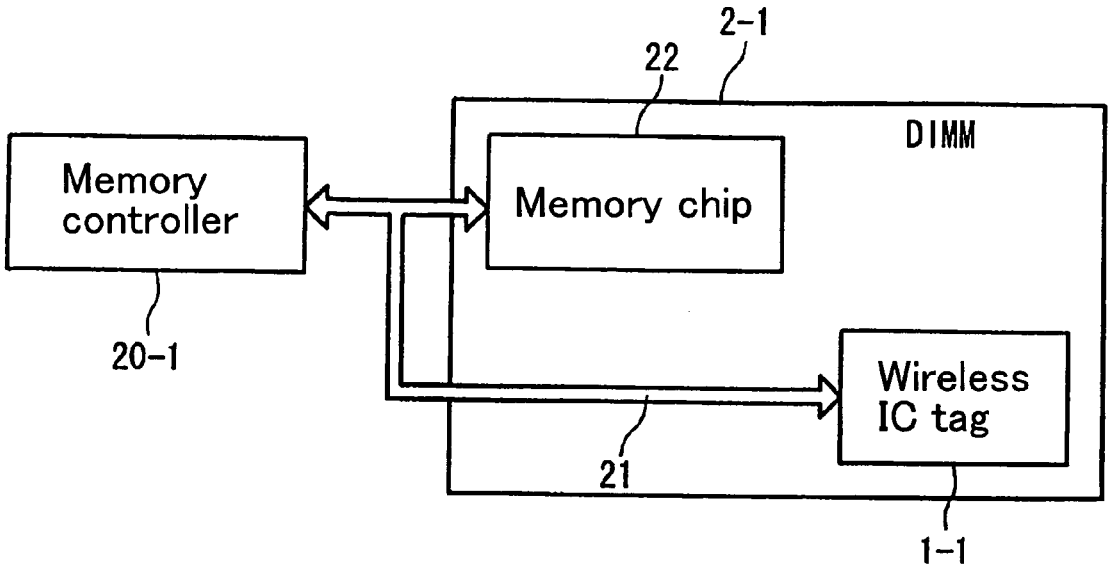
FIG. 4 is a block diagram showing an example in which a wireless IC tag is mounted on a DIMM.

FIG. 4 shows an example in which wireless IC tag 1-1 is mounted on DIMM 2-1. As shown in FIG. 4, DIMM 2-1 has memory chip 22 connected to memory controller 20-1 as component control device 20 through a memory bus. Wireless IC tag 1-1 is connected to memory controller 20-1 through a portion of the signal line of the memory bus. In response to a request from wireless IC tag 1-1, memory controller 20-1 notifies wireless IC tag 1-1 of status signal 2-1 representing a temperature, a voltage value, etc. detected from memory chip 22.

Figure 5:
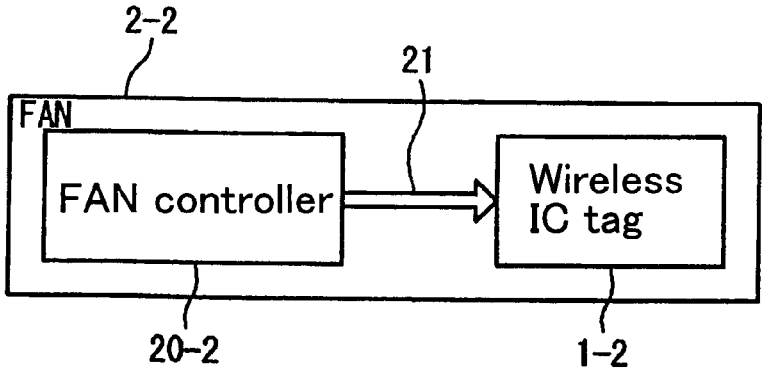
FIG. 5 is a block diagram showing an example in which a wireless IC tag is mounted on a FAN.

FIG. 5 shows an example in which wireless IC tag 1-2 is mounted on FAN 2-2. As shown in FIG. 5, FAN 2-2 has FAN controller 20-2 for measuring an operating voltage, a rotational speed, etc. of FAN 2-2. Wireless IC tag 1-2 is connected to FAN controller 20-2. In response to a request from wireless IC tag 1-2, FAN controller 20-2 notifies wireless IC tag 1-2 of status signal 21 representing the measured operating voltage, rotational speed, etc. of FAN 2-2.

External wireless module 6 comprises a portable reader such as a handy terminal, for example, and collects status information of component units 2 from wireless IC tags 1 through wireless links 7. External wireless module 6 is used in the maintenance of the computer system.

Figure 6:
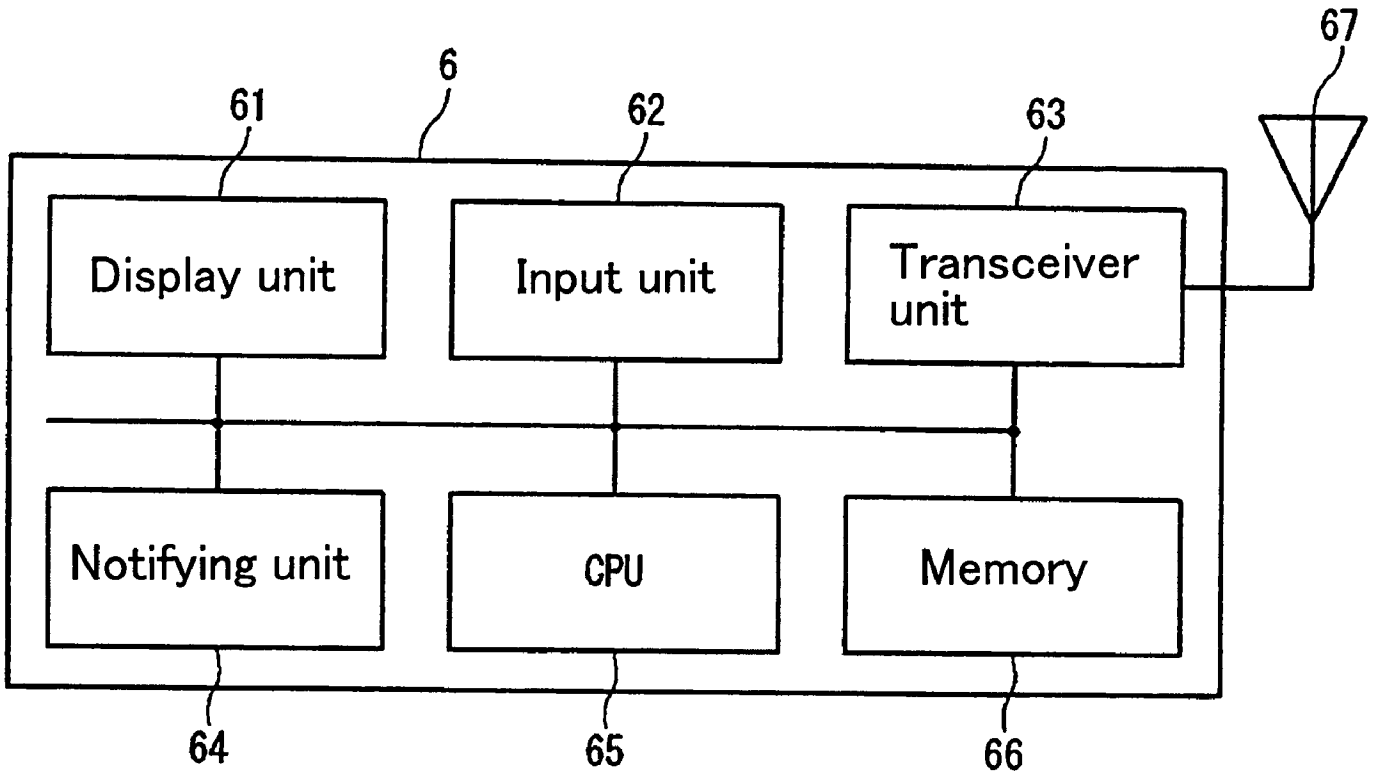
FIG. 6 is a block diagram of an external wireless module of the component unit monitoring system according to the first embodiment of the present invention.

FIG. 6 shows details of external wireless module 6 in block form. As shown in FIG. 6, external wireless module 6 comprises display unit 61, input unit 62, transceiver unit 63, notifying unit 64, CPU 65, memory 66, and antenna 67.

Display unit 61 comprises a liquid crystal display unit, an EL display unit, or the like for displaying status information acquired from wireless IC tags 1. Input unit 62 issues an instruction to acquire status information to notifying unit 64 based on a key action made by the user. In response to the instruction to acquire status information from input unit 62, notifying unit 64 generates and sends a READ_LOG packet to each wireless IC tag 1. The READ_LOG packet includes a program for requesting each wireless IC tag 1 to send status information. Transceiver unit 63 exchanges various signals and data with wireless IC tags 1 through antenna 67. CPU 65 controls various signals and data in external wireless module 6 and also controls operation of transceiver unit 63 and notifying unit 64. Acquisition of component configurational information:

Operation of the component unit monitoring system according to the first embodiment for acquiring component configurational information will be described below with reference to FIGS. 7 through 12.

Figure 9:
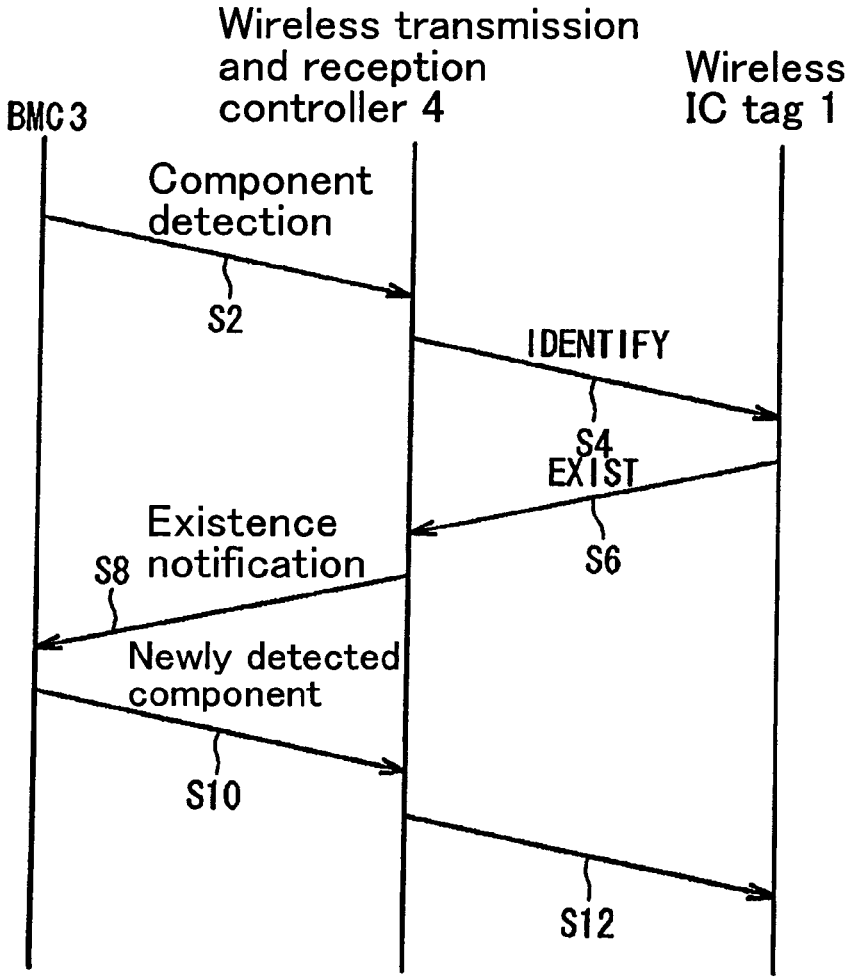
FIG. 9 is a sequence diagram of a sequence for detecting a component unit that is newly installed in a computer system according to the first embodiment of the present invention.
Figure 10:
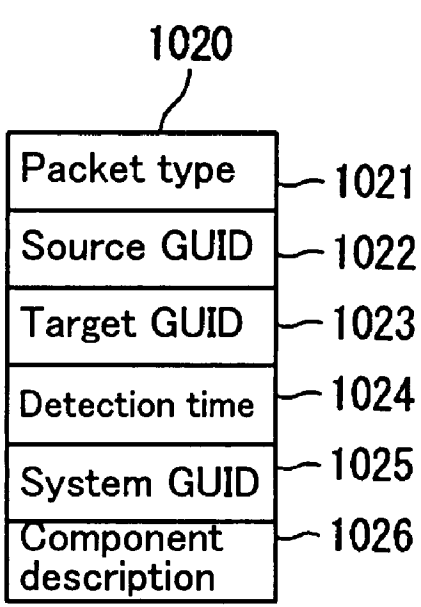
FIG. 10 is a diagram showing the formats of wireless packets used in the process of detecting a new component unit.
Figure 10:
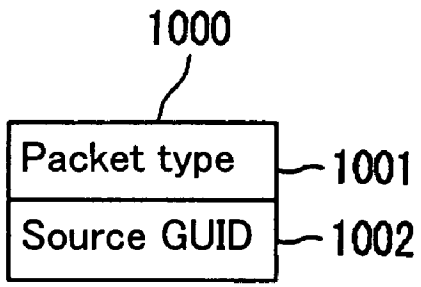
Figure 10:
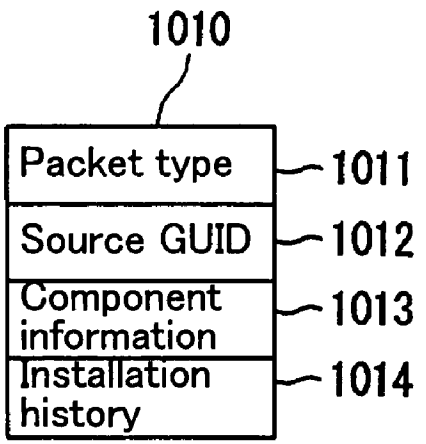

FIG. 9 shows a sequence for detecting component unit 2 that is newly installed in the computer system, and FIG. 10 shows the formats of wireless packets used in the process of detecting a new component unit.

For detecting a new component unit, BMC control circuit 35 of BMC 3 periodically issues a component detection instruction to wireless transmission and reception controller 4 through a physically connected signal line in step S2 shown in FIG. 9. In response to the component detection instruction, wireless transmission and reception controller 4 sends IDENTIFY packet 1000 (see also FIG. 10) to each wireless IC tag 1 through antenna 5 in step S4. IDENTIFY packet 1000 includes packet type 1001 and source GUID 1002 representing BMC 3.

In response to IDENTIFY packet 1000, each wireless IC tag 1 sends EXIST packet 1010 to wireless transmission and reception controller 4 through wireless link 7 in step S6. Wireless transmission and reception controller 4 converts EXIST packet 1010 received from wireless IC tag 1 into a format for transmission to BMC 3, and then sends converted EXIST packet 1010 as an existence notification to detection processor 31 of BMC 3 in step S8. EXIST packet 1010 includes packet type 1011, source GUID 1012, and information stored in component information area 101 and installation history area 105 of memory map 100 of wireless IC tag 1, i.e., component information 1013 and installation history 1014.

When detection processor 31 of BMC 3 receives EXIST packet 1010 from each wireless IC tag 1 through wireless transmission and reception controller 4, detection processor 31 analyzes component information 1013 and installation history 1014 included in EXIST packet 1010, and compares them with component unit information stored in BMC memory 36. If there is newly detected component unit 2 or if the computer system finally connected to component unit 2 is different from the computer system which is being connected to BMC 3, then detection processor 31 determines component unit 2 as a newly detected component unit in step S10.

When a new component unit is detected, detection processor 31 sends DETECT packet 1020 through wireless transmission and reception controller 4 to wireless IC tag 1 to write an installation history into wireless IC tag 1 in step S12.

DETECT packet 1020 includes packet type 1021, source GUID 1022, target GUID 1023 representing wireless IC tag 1, detection time 1024 at which the new component unit was detected, system GUID 1025 representing an identifier of the computer system, and system description 1026 representing the name and version information of the computer system.

Detection processor 31 also adds new component information to the component configurational information stored in BMC memory 36. Furthermore, detection processor 31 deletes information of component unit 2 which was not detected as component unit 2 included in the component configurational information, from BMC memory 36 because detection processor 31 regards undetected component unit 2 as being disconnected from the computer system.

When tag control circuit 12 of each wireless IC tag 1 receives DETECT packet 1020, tag control circuit 12 compares target GUID 1023 included in received DETECT packet 1020 with component GUID 111 stored in tag memory 10. If target GUID 1023 and component GUID 111 are identical to each other, then tag control circuit 12 writes detection time 1024, system GUID 1025, and system description 1026 which are included in DETECT packet 1020 into installation history area 105 of memory map 100.

Figure 11:
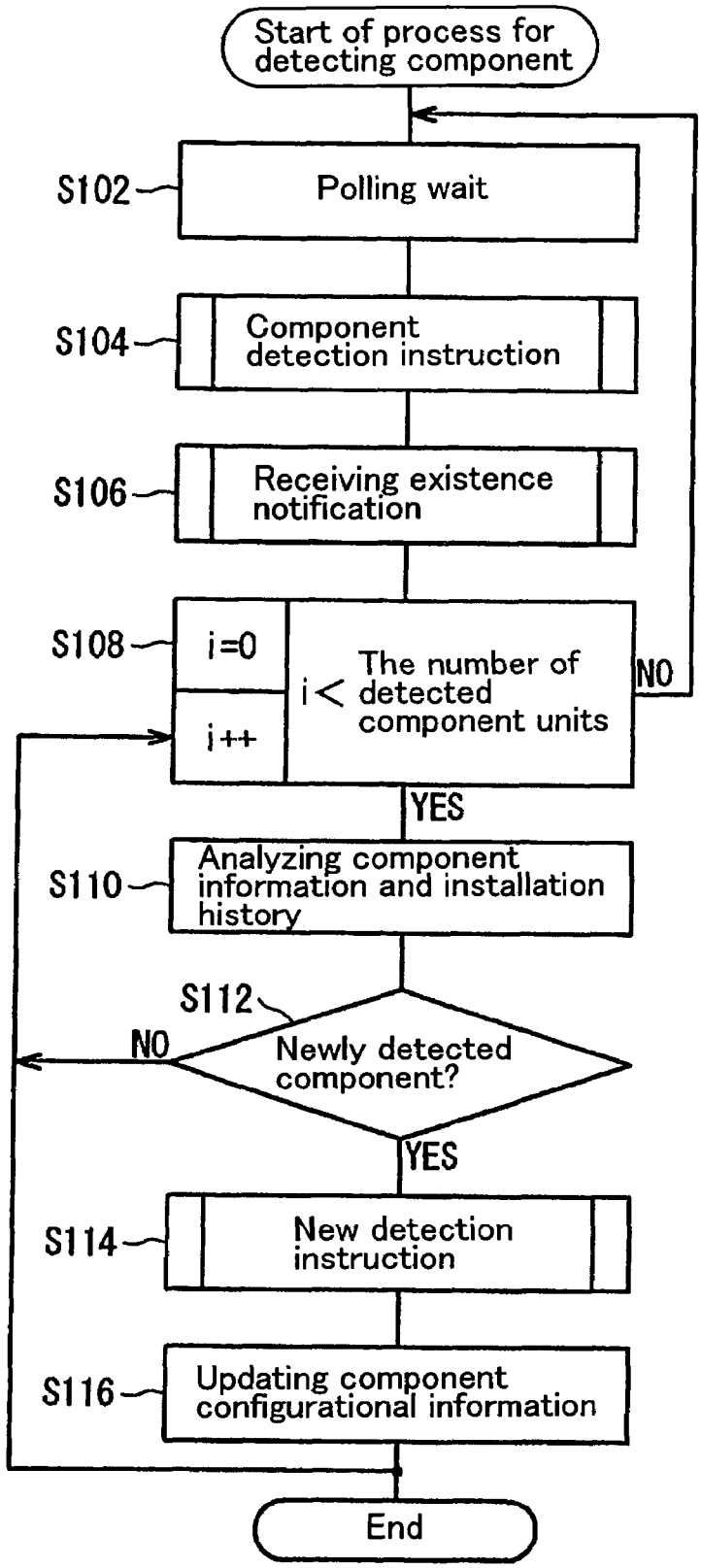
FIG. 11 is a flowchart of a process performed by the BMC for detecting a new component unit.

FIG. 11 shows a process performed by BMC 3 for detecting a new component unit. For detecting a new component unit, BMC control circuit 35 of BMC 3 periodically issues a component detection instruction to wireless transmission and reception controller 4 through a physically connected signal line in steps S102, 102 shown in FIG. 11.

When detection processor 31 receives an existence notification from wireless transmission and reception controller 4 which has received EXIST packet 1010 from each wireless IC tag 1 in step S106, detection processor 31 compares the number i of component units 2 connected to the computer system with the number of detected component units from which existence notifications have been received in step S108. The initial value of the number i is 0. If i< the number of detected component units (YES in step S108), then detection processor 31 analyzes component information 1013 and installation history 1014 included in EXIST packet 1010 in step S110. If system GUID 152 of installation history 1014 is different from the computer system connected to BMC 3, then component unit 2 corresponding to component information 1013 is judged as a new component unit (YES in step S112). If component unit 2 is not judged as a new component unit (NO in step S112), the number of component units not judged as new component units is added to as a present number to the number i in step S108.

If component unit 2 is judged as a new component unit, then detection processor 31 issues a new detection instruction for wireless IC tag 1 mounted on component unit 2 corresponding to component information 1013 to wireless transmission and reception controller 4 in step S114. At this time, detection processor 31 sends detection time 1024 together with the new detection instruction to wireless transmission and reception controller 4. After having issued the new detection instruction, detection processor 31 stores component information 1013 and detection time 1024 in BMC memory 36, thereby updating the component configurational information in step S116.

Figure 12A:
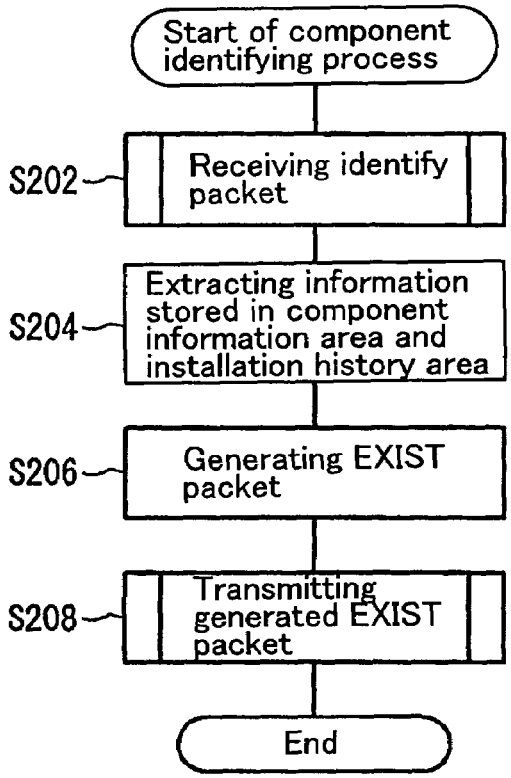
FIG. 12A is a flowchart of a component identifying process for confirming a configuration of a computer system.
Figure 12B:
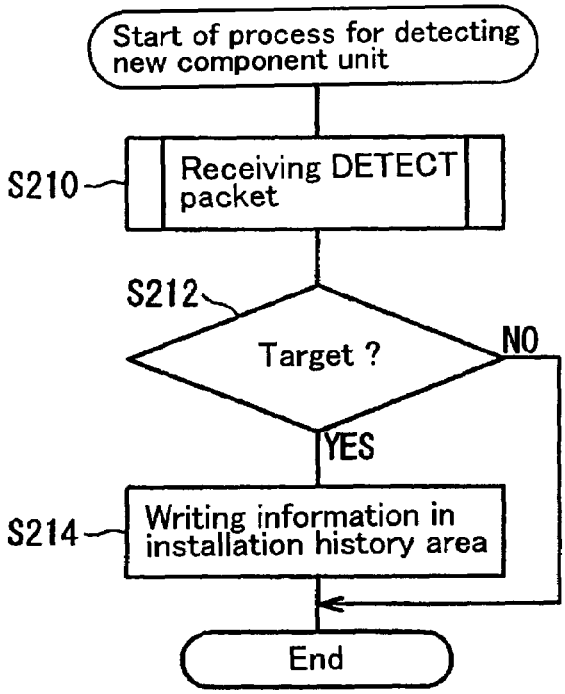
FIG. 12B is a flowchart of a process of detecting a new component unit.

FIGS. 12A and 12B show operation sequences of wireless IC tab 1 for detecting a new component unit. FIG. 12A shows a component identifying process for confirming a configuration of the computer system, i.e., whether there is component unit 2 or not. When wireless IC tag 1 receives IDENTIFY packet 1000 from wireless transmission and reception controller 4 through wireless link 7 in step S202, power supply 11 operates based on electromagnetic waves from wireless transmission and reception controller 4 and supplies electric energy to the other parts of wireless IC tag 1. Tag control circuit 12 extracts information stored in component information area 101 and installation history area 105 from tag memory 10 in step S204, and generates EXIST packet 1010 including the extracted information in step S206. Tag control circuit 12 then sends generated EXIST packet 1010 through wireless link 7 to wireless transmission and reception controller 4 in step S208.

FIG. 12B shows a process of detecting a new component unit. When wireless IC tag 1 receives DETECT packet 1020 from wireless transmission and reception controller 4 through wireless link 7 in step S210, power supply 11 operates based on electromagnetic waves from wireless transmission and reception controller 4 and supplies electric energy to the other parts of wireless IC tag 1. Tag control circuit 12 compares component GUID 111 in memory map 100 and target GUID 1023 in DETECT packet 1020 with each other to determine whether the GUIDs are identical to each other or not in step S212. If the compared GUIDs are identical to each other, then tag control circuit 12 writes detection time 1024, system GUID 1025, and system description 1026 included in DETECT packet 1020 respectively into recognition time 151, system GUID 152, and system description 153 in installation history area 105 of memory map 100 in step S214.

As described above, BMC 3 is capable of managing altogether how component units 2 are installed in the computer system through wireless links 7. MBC 3 is also capable of controlling each component unit 2 to store its installation history. Even when component unit 2 is removed from the computer system, the user can confirm the installation history of each removed component unit 2.

Since wireless IC tags 1 store component configurational information, it is not necessary to use an NVRAM inherent to the computer system for storing component configurational information.

It is also possible to dynamically grasp the configuration of the computer system by accessing the component configurational information of BMC 3 from the program of the computer system.

Acquisition of Fault Information:

Operation of the component unit monitoring system according to the first embodiment for acquiring fault information will be described below with reference to FIGS. 7, 13 through 16.

Figure 13:
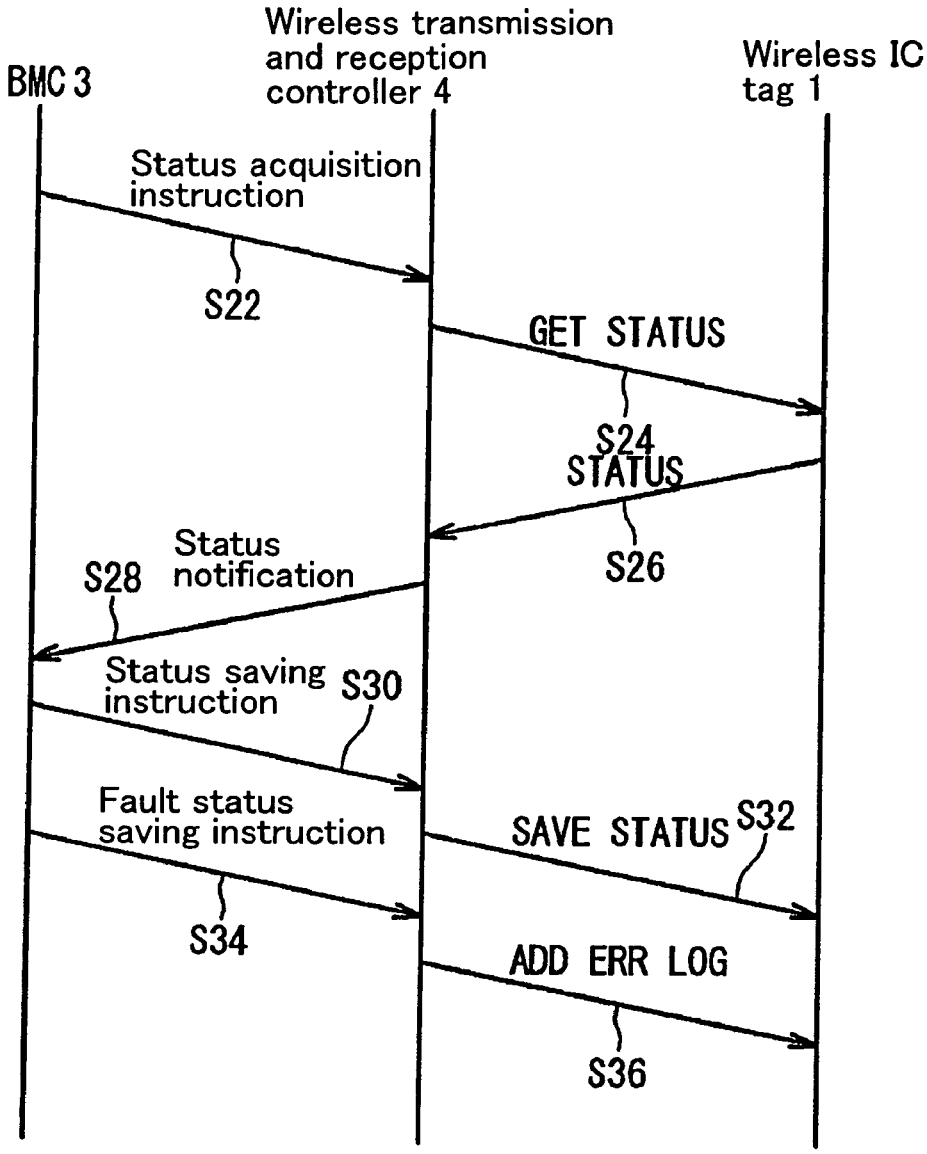
FIG. 13 is a sequence diagram of a sequence for detecting fault information of a component unit according to the first embodiment of the present invention.
Figure 14:
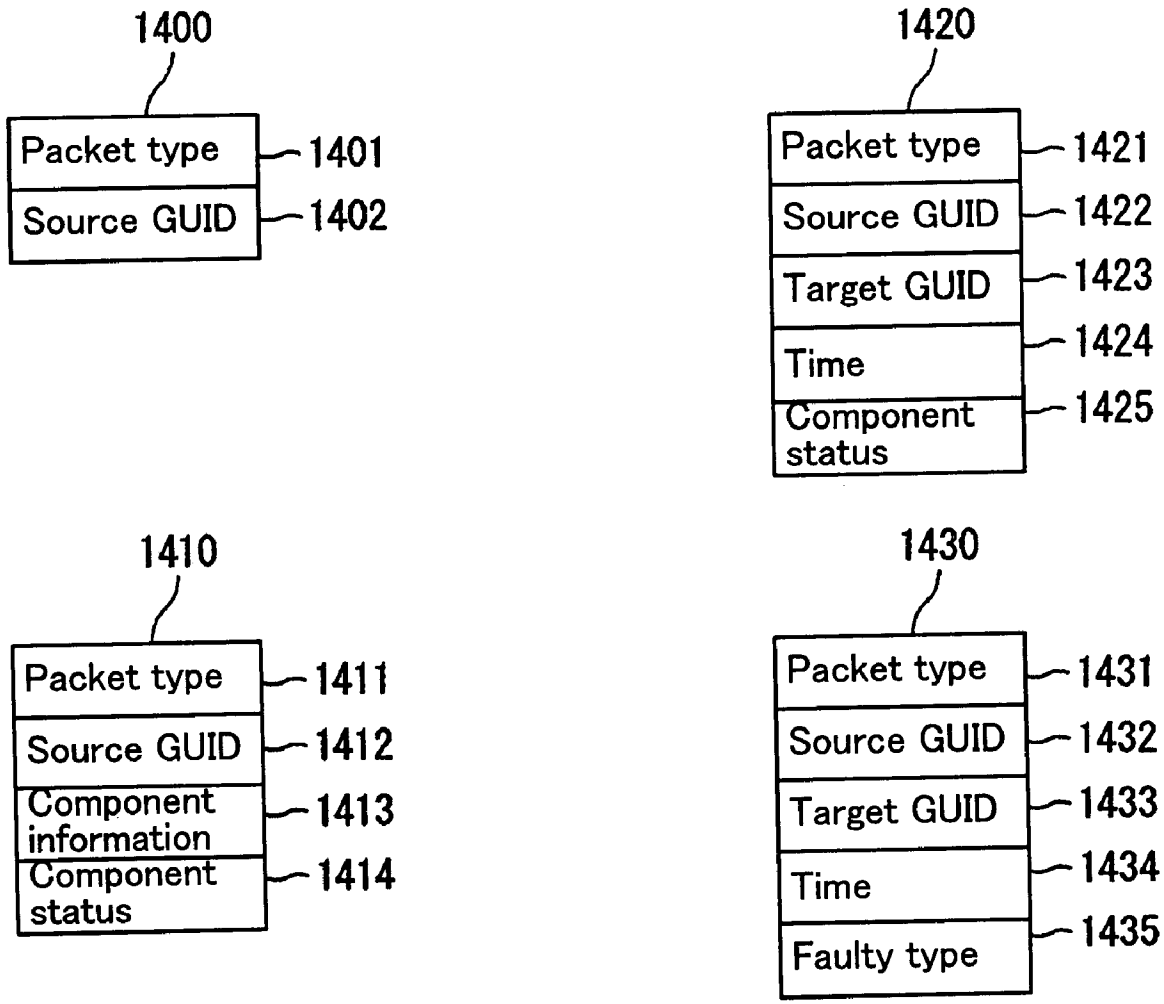
FIG. 14 is a diagram showing the formats of wireless packets used in the fault information detecting process according to the first embodiment of the present invention.

FIG. 13 shows a sequence for detecting fault information of component unit 2 connected to the computer system, and FIG. 14 shows the formats of wireless packets used in the fault information detecting process.

For detecting fault information of component unit 2, BMC control circuit 35 of BMC 3 periodically issues a status acquisition instruction to wireless transmission and reception controller 4 through a physically connected signal line in step S22 shown in FIG. 13. In response to the status acquisition instruction, wireless transmission and reception controller 4 sends GET_STATUS packet 1400 (see also FIG. 14) to each wireless IC tag 1 through antenna 5 in step S24. GET_STATUS packet 1400 includes packet type 1401 and source GUID 1402 representing BMC 3.

In response to GET_STATUS packet 1400, each wireless IC tag 1 sends STATUS packet 1410 to wireless transmission and reception controller 4 through wireless link 7 in step S26. Wireless transmission and reception controller 4 converts STATUS packet 1410 received from wireless IC tag 1 into a format for transmission to BMC 3, and then sends converted STATUS packet 1410 as a status notification to error determining unit 32 of BMC 3 in step S28. STATUS packet 1410 includes packet type 1411, source GUID 1412, and information stored in component information area 101 and component status area 102 of memory map 100 of wireless IC tag 1, i.e., component information 1413 and component status 1414.

When BMC control circuit 36 of BMC 3 receives STATUS packet 1410 from each wireless IC tag 1, BMC control circuit 36 issues a status saving instruction to wireless transmission and reception controller 4 for writing a status history into each wireless IC tag 1 in step S30. In response to the status saving instruction, wireless transmission and reception controller 4 sends SAVE_STATUS packet 1420 to each wireless IC tag 1 in step S32. SAVE_STATUS packet 1420 includes packet type 1421, source GUID 1422, target GUID 1423 representing wireless IC tag 1, time 1424 at which a fault was detected, and component status 1425 based on received component status 1414. Target GUID 1423 and component status 1425 are generated based on the values included in GET_STATUS packet 1400.

When tag control circuit 12 of each wireless IC tag 1 receives SAVE_STATUS packet 1420, tag control circuit 12 compares target GUID 1423 included in received SAVE_STATUS packet 1420 with component GUID 111 in tag memory 10. If the compared GUIDs are identical to each other, then tag control circuit 12 writes time 1424 and component status 1245 included in SAVE_STATUS packet 1420 respectively into time 131 and status value 132 in status history area 103 in memory map 100.

Error determining unit 32, which has received STATUS packet 1410 from each wireless IC tag 1 in step S28, analyzes component status 1414 contained in received STATUS packet 1410, and determines whether component unit 2 is suffering a fault, e.g., a reduction in the rotational speed of FAN or a memory ECC (Error Correction Code) error, or not. If error determining unit 32 detects a fault of component unit 2, then error determining unit 32 issues a fault status saving instruction to wireless transmission and reception controller 4 for writing a fault information history into wireless IC tag 1 that is mounted on faulty wireless IC tag 2 in step S34. In response to the fault status saving instruction, wireless transmission and reception controller 4 sends ADD_ERR_LOG packet 1430 to each wireless IC tag 1 in step S36. ADD_ERR_LOG packet 1430 includes packet type 1431, source GUID 1432, target GUID 1433 representing faulty component unit 2, time 1434 at which the fault was detected, and faulty type 1435 representing the type of the fault.

When tag control circuit 12 of each wireless IC tag 1 receives ADD_ERR_LOG packet 1430, tag control circuit 12 compares target GUID 1433 included in received ADD_ERR_LOG packet 1430 with component GUID 111 in tag memory 10. If the compared GUIDs are identical to each other, then tag control circuit 12 writes time 1434, source GUID 1432, and fault type 1435 included in ADD_ERR_LOG packet 1430 respectively into time 141, faulty system GUID 142, and fault type value 143 in fault information history area 104 in memory map 100.

Figure 15:
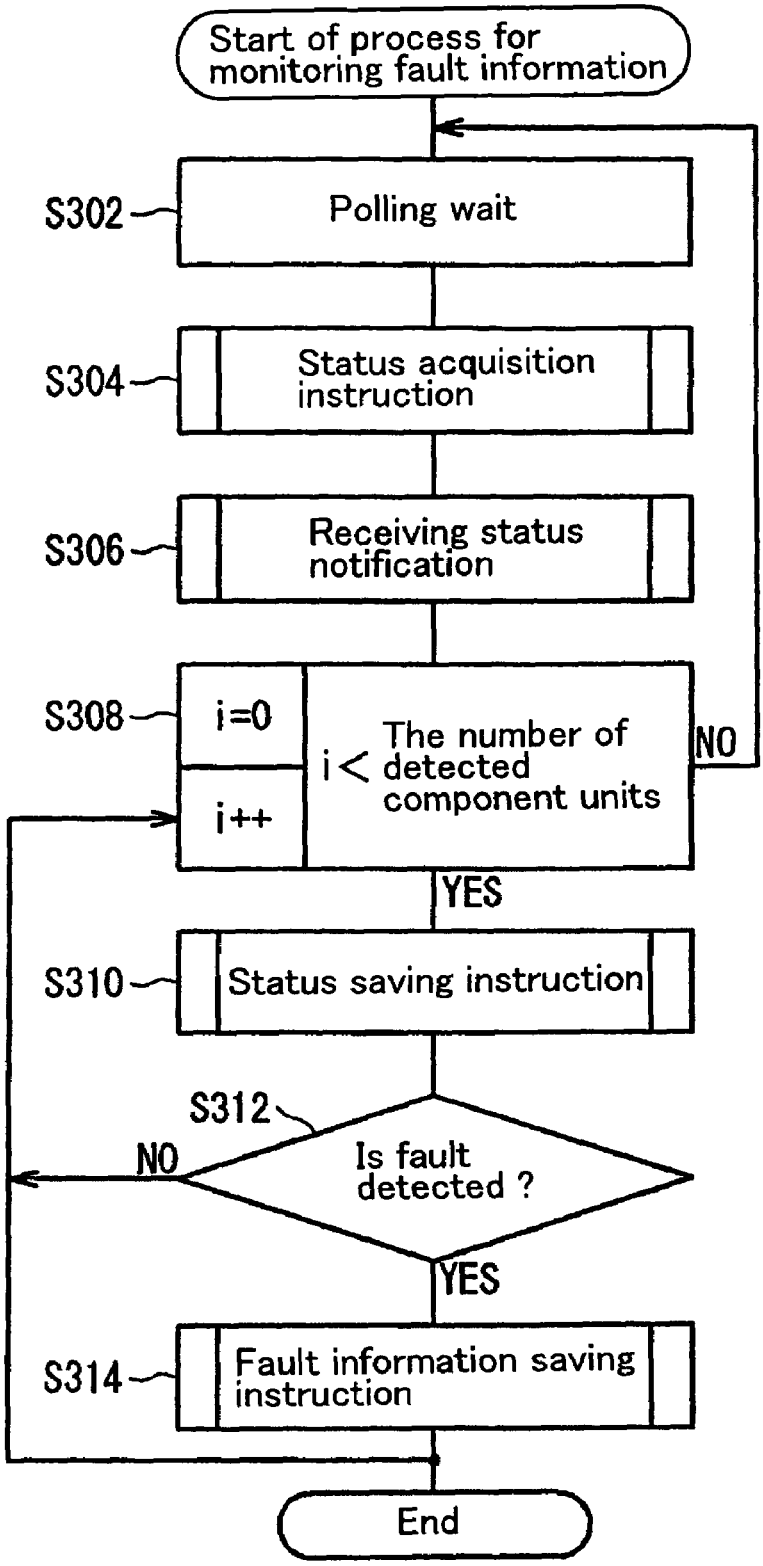
FIG. 15 is a flowchart of a process performed by the BMC for monitoring fault information.

FIG. 15 shows a process performed by BMC 3 for monitoring fault information. For detecting status information of component unit 2, BMC control circuit 35 of BMC 3 periodically issues a status acquisition instruction to wireless transmission and reception controller 4 through a physically connected signal line in steps S302, 304 shown in FIG. 15. When error determining unit 32 receives a status notification from wireless transmission and reception controller 4 which has received STATUS packet 1410 from each wireless IC tag 1 in step S306, error determining unit 32 compares the number i of normal component units with the number of detected component units from which existence notifications have been received in step S308. The initial value of the number i is 0. If i<the number of detected component units (YES in step S308), then error determining unit 32 issues a status saving instruction to wireless transmission and reception controller 4 in step S310.

Error determining unit 32 analyzes component information 1413 and component status 1414 included in STATUS packet 1410 received from wireless IC tag 1, and determines whether there is a fault or not in step S312. Specifically, error determining unit 32 compares component status 1414 with a threshold corresponding to status value 132 obtained from status signal 21 of each component unit 2 and stored in BMC memory 36 to determine whether component unit 2 is suffering a fault or not. Component status 1414 represents, for example, the temperature and voltage of DIMM 2-1 or the present rotational speed of FAN 2-2. It is judged that component unit 2 is suffering a fault if component status 1414 is smaller than or greater than the threshold (YES in step S312). If it is judged that component unit 2 is not suffering a fault, then the number of component units 2 that are judged as not suffering a fault is added as the present number of normal component units to the number i (NO in step S312).

If error determining unit 32 judges that component unit 2 is suffering a fault based on component information 1413 in STATUS packet 1410, then error determining unit 32 issues a fault information saving instruction for wireless IC tag 1 mounted on component unit 2 which corresponds to component information 1413 in STATUS packet 1410 to wireless transmission and reception controller 4 in step S314.

Figure 16A:
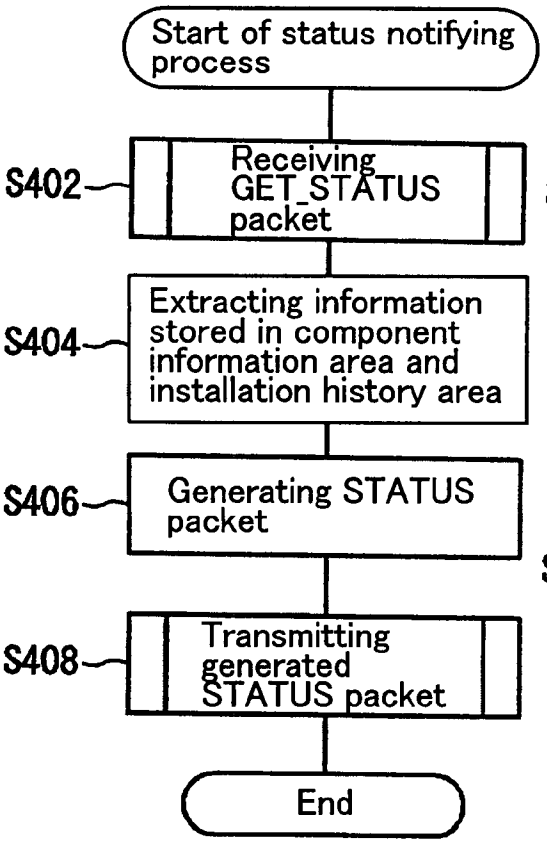
FIG. 16A is a flowchart of an operation sequence of the wireless IC tag for notifying the BMC of the status of a component unit.
Figure 16B:
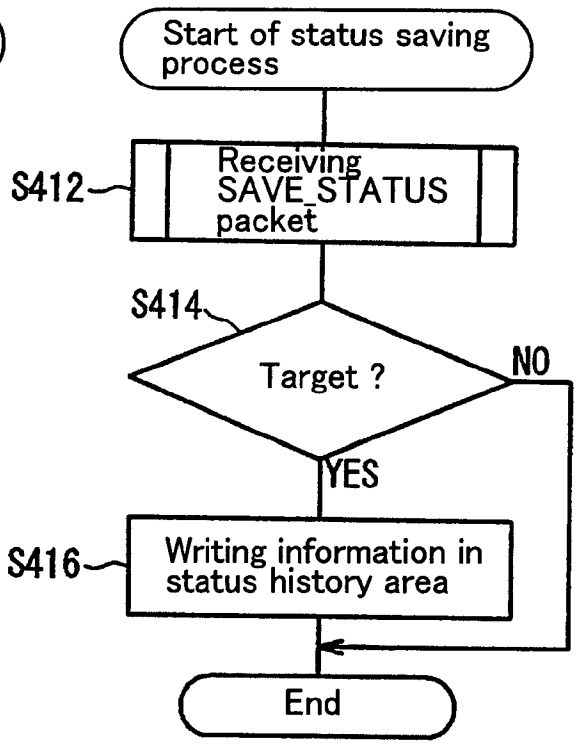
FIG. 16B is a flowchart of a process performed by the wireless IC tag for saving the status value of a component unit.
Figure 16C:
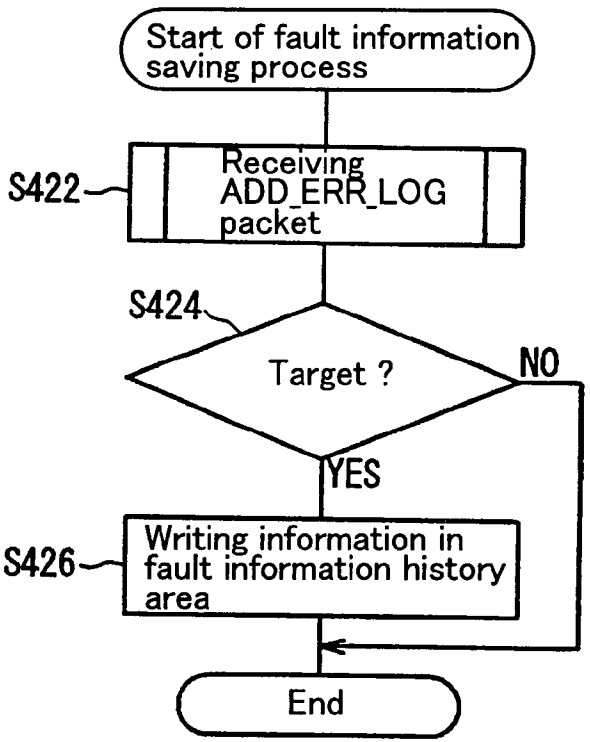
FIG. 16C is a flowchart of a process performed by the wireless IC tag for saving the fault information of a component unit.

FIGS. 16A through 16C show operation sequences of wireless IC tab 1 for detecting fault information of component unit 2. FIG. 16A shows a process of wireless IC tag 1 for notifying BMC 3 of the status of component unit 2. When wireless IC tag 1 receives GET_STATUS packet 1400 from wireless transmission and reception controller 4 through wireless link 7 in step S402, power supply 11 operates based on electromagnetic waves from wireless transmission and reception controller 4 and supplies electric energy to the other parts of wireless IC tag 1. Tag control circuit 12 extracts information stored in component information area 101 and component status area 102 from tag memory 10 in step S404, and generates STATUS packet 1410 including the extracted information in step S406. Tag control circuit 12 then sends generated STATUS packet 1410 through wireless link 7 to wireless transmission and reception controller 4 in step S408.

FIG. 16B shows a process performed by wireless IC tag 1 for saving the status value of component unit 2. When wireless IC tag 1 receives SAVE_STATUS packet 1420 from wireless transmission and reception controller 4 through wireless link 7 in step S412, power supply 11 operates based on electromagnetic waves from wireless transmission and reception controller 4 and supplies electric energy to the other parts of wireless IC tag 1. Tag control circuit 12 compares component GUID 111 in memory map 100 and target GUID 1422 in SAVE_STATUS packet 1420 with each other. If the compared GUIDs are identical to each other (YES in step S414), then tag control circuit 12 writes detection time 1424 and component status 1424 included in SAVE_STATUS packet 1420 respectively into time 131 and status value 132 in status history area 103 of memory map 100 in step S416.

FIG. 16C shows a process performed by wireless IC tag 1 for saving fault information of component unit 2. When wireless IC tag 1 receives ADD_ERR_LOG packet 1430 from wireless transmission and reception controller 4 through wireless link 7 in step S422, power supply 11 operates based on electromagnetic waves from wireless transmission and reception controller 4 and supplies electric energy to the other parts of wireless IC tag 1. Tag control circuit 12 compares component GUID 111 in memory map 100 and target GUID 1432 in ADD_ERR_LOG packet 1430 with each other. If the compared GUIDs are identical to each other (YES in step S424), then tag control circuit 12 writes detection time 1434 and fault type 1435 included in ADD_ERR_LOG packet 1430 respectively into time 141 and fault type 143 in fault information history area 104 of memory map 100 in step S426. Tag control circuit 12 also writes system GUID 152 of the computer system that is presently connected to component unit 2 as faulty system GUID 142 based on the component GUID stored in installation history area.

As described above, BMC 3 manages the statuses of component units 2 altogether through wireless links 7, and controls each component unit 2 to store its fault history. In addition, BMC3 analyzes the status information which is collected by wireless IC tag 1 to detect a fault of component unit 2, and controls wireless IC tag 1 to store the detected fault information as a fault history. Therefore, it is easy to analyze the fault histories of individual component units 2.

Acquisition of Status Information by External Wireless Module 6.

Figure 17:
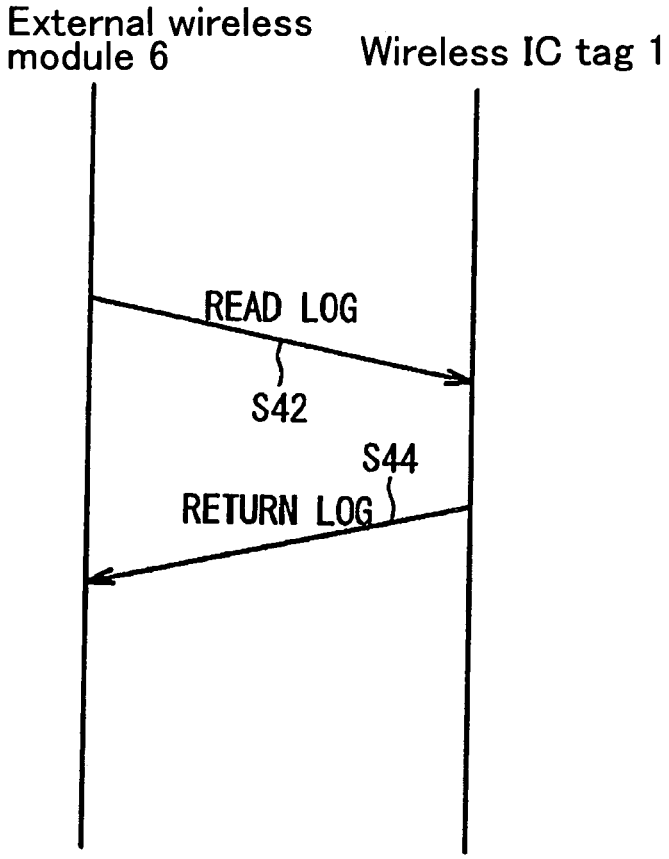
FIG. 17 is a sequence diagram of an operation sequence of the external wireless module for acquiring status information.
Figure 18:
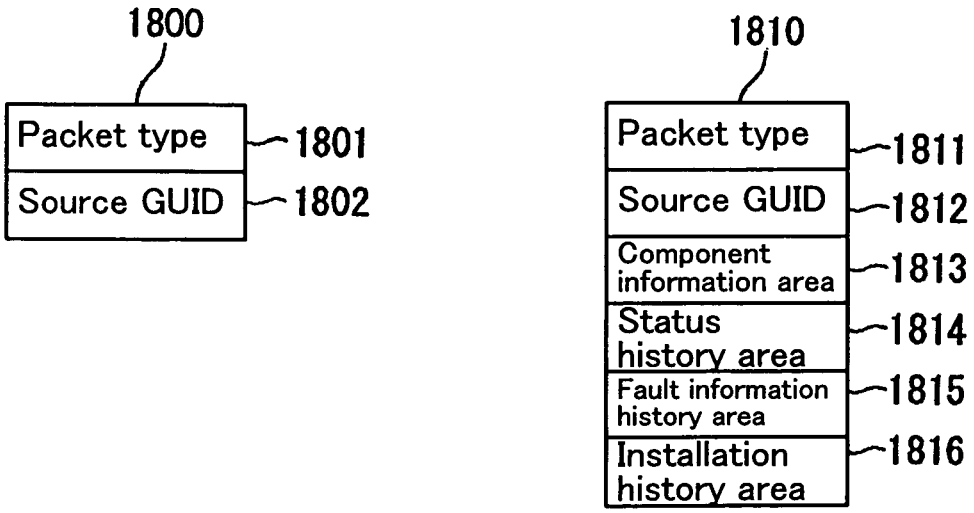
FIG. 18 is a diagram showing the formats of wireless packets used in the status information acquiring process.

Operation of external wireless module 6 of the component unit monitoring system according to the first embodiment for acquiring status information will be described below with reference to FIGS. 7, 17 through 20. FIG. 17 shows an operation sequence of external wireless module 6 for acquiring status information, and FIG. 18 shows the formats of wireless packets used in the status information acquiring process.

In response to a status information acquiring instruction from input unit 62, notifying unit 64 of external wireless module 6 generates READ_LOG packet 1800 (see FIG. 18) including packet type 1801 and source GUID 1802 representing external wireless module 6 as a source, and sends generated READ_LOG packet 1800 to wireless IC tags 1 that are located within the range of wireless links 7 in step S42 shown in FIG. 17.

When tag control circuit 12 of each wireless IC tag 1 receives READ_LOG packet 1800, tag control circuit 12 extracts information stored in component information area 101, status history area 103, fault information history area 104, and installation history area 105 in memory map 100 from tag memory 10, stores the extracted information respectively into component information area 1813, status history area 1814, fault information history area 1815, and installation history area 1816, and adds packet type 1811 and source GUID 1812, thereby generating RETURN_LOG packet 1810. Tag control circuit 12 sends generated RETURN_LOG packet 1810 through wireless link 7 to external wireless module 6 in step S44.

When external wireless module 6 receives RETURN_LOG packet 1810 from each wireless IC tag 1, CPU 6 of external wireless module 6 stores the information included in RETURN_LOG packet 1810 into memory 66.

Figure 19:
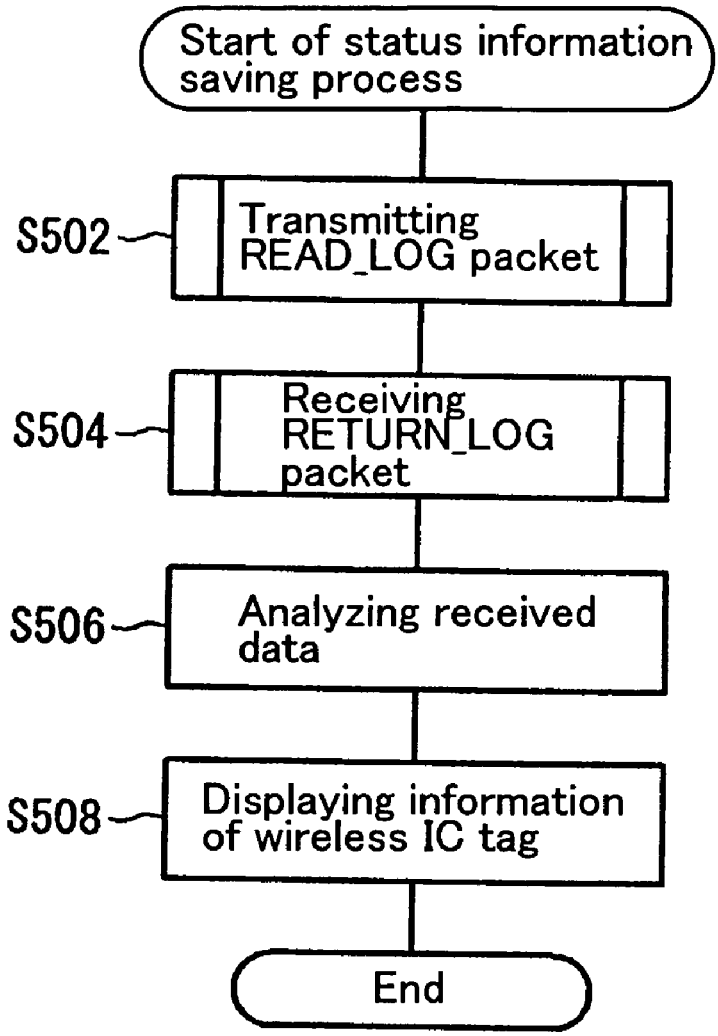
FIG. 19 is a flowchart of a process performed by the external wireless module for acquiring status information.

FIG. 19 shows a process performed by external wireless module 6 for acquiring status information. In response to a status information acquiring instruction from input unit 62, notifying unit 64 of external wireless module 6 generates READ_LOG packet 1800 (see FIG. 18) including packet type 1801 and source GUID 1802 representing external wireless module 6 as a source, and sends generated READ_LOG packet 1800 to wireless IC tags 1 that are located within the range of wireless links 7 in step S502 shown in FIG. 19.

When external wireless module 6 receives RETURN_LOG packet 1810 from each wireless IC tag 1 in step S504, CPU 6 of external wireless module 6 refers to source GUID 1812 in RETURN_LOG packet 1810, and stores component information area 1813, status history area 1814, fault information history area 1815, and installation history area 1816 into memory 66 with respect to each component unit 2 in step S506. The component information, the status history, the fault information history, and the installation history which correspond to component unit 2 entered from input unit 62 are selectively displayed on display unit 61.

Figure 20:
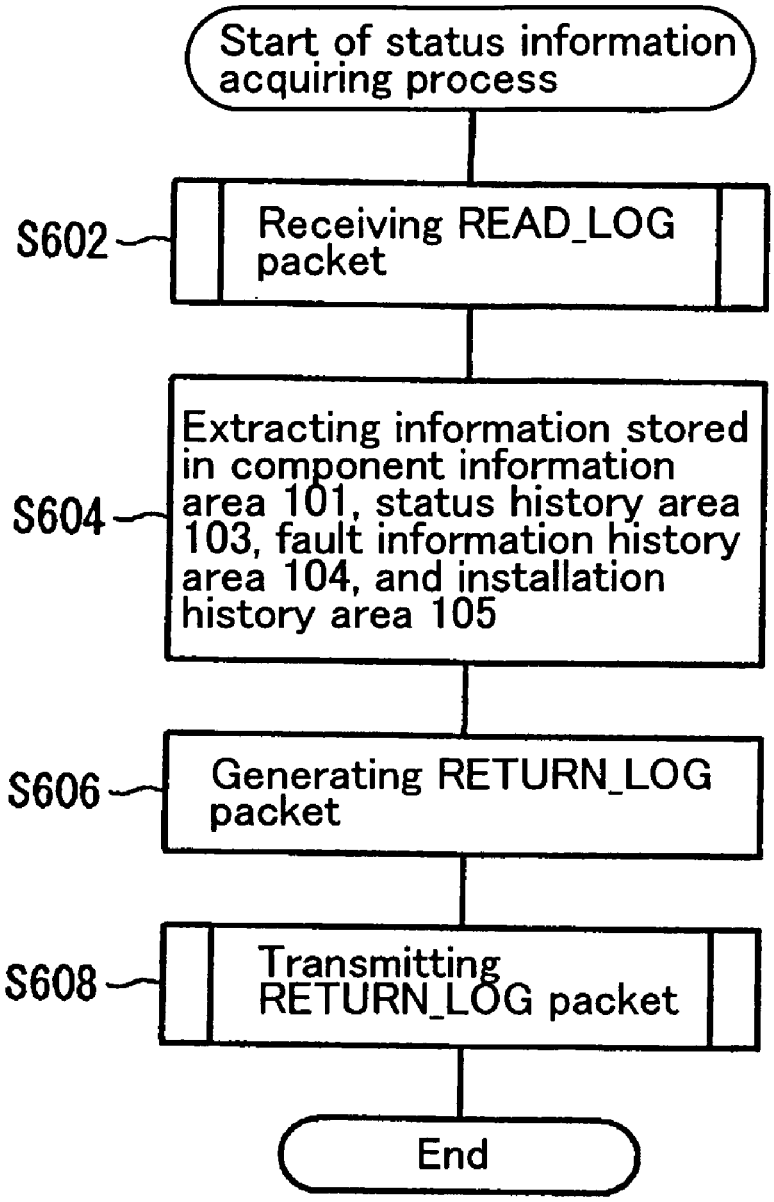
FIG. 20 is a flowchart of a process performed by the wireless IC tag for acquiring status information.

FIG. 20 shows a process performed by wireless IC tag 1 for acquiring status information. Wireless IC tag 2 that can be connected to external wireless module 6 through wireless link 7 receives READ_LOG packet 1800, and power supply 11 operates based on electromagnetic waves from external wireless module 6 and supplies electric energy to the other parts of wireless IC tag 1 in step S602. Tag control circuit 12 of wireless IC tag 1 which has received READ_LOG packet 1800 extracts information stored in component information area 101, status history area 103, fault information history area 104, and installation history area 105 in memory map 100 from tag memory 10, stores the extracted information respectively into component information area 1813, status history area 1814, fault information history area 1815, and installation history area 1816, and adds packet type 1811 and source GUID 1812, thereby generating RETURN_LOG packet 1810 in step S606. Tag control circuit 12 sends generated RETURN_LOG packet 1810 through wireless link 7 to external wireless module 6 in step S608.

Since an error, such as a FAN error, a memory error, etc. that has occurred in each component unit 2 is written in wireless IC tag 1 attached to component unit 2, as described above, the fault history of each component unit 2 can easily be analyzed from the information thus stored in wireless IC tag 1.

When the computer system is serviced for maintenance, external wireless module 6 is used to acquire component configurational information and fault information, and also to identify faulty component units regardless of whether the computer system or any faulty component units are turned on or off.

Furthermore, as error information is recorded in fault information history area 104 of each wireless IC tag 1, the error history of each component unit 2 can be traced.

2nd Embodiment

A component unit monitoring system according to a second embodiment of the present invention will be described below with reference to FIGS. 7, 21 through 26.

Figure 21:
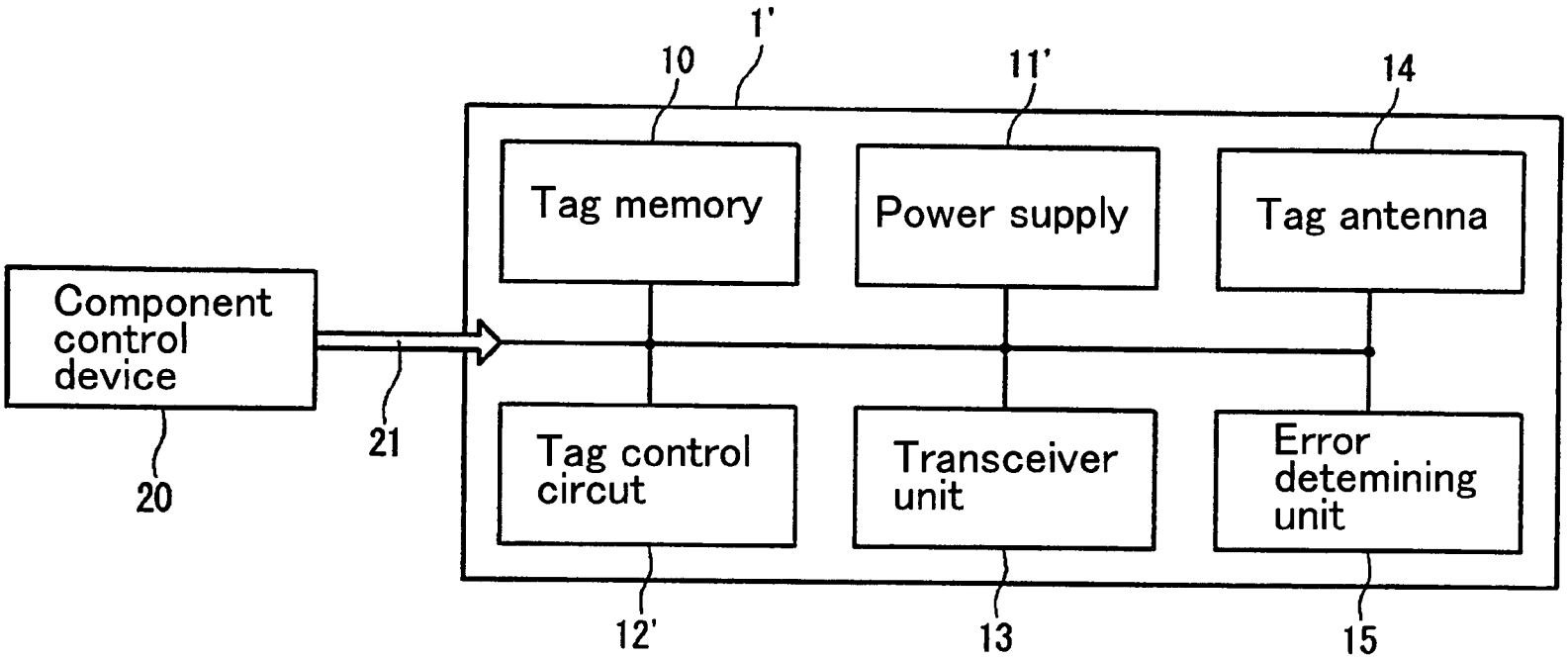
FIG. 21 is a block diagram of a wireless IC tag used according to a second embodiment of the present invention.

The component unit monitoring system according to the second embodiment employs active wireless IC tag 1' having a cell in its power supply 11' as shown in FIG. 21. Active wireless IC tag 1' detects a fault of associated component unit 2 on its own, and sends a packet including component information and fault information to BMC 3' (see FIG. 22) through wireless link 7 and wireless transmission and reception controller 4.

The component unit monitoring system according to the second embodiment is of an arrangement which is the same as the component unit monitoring system according to the first embodiment.

Active wireless IC tag 1' operates on electric energy supplied from the cell in power supply 11' for communicating with wireless transmission and reception controller 4 and external wireless module 6. Wireless transmission and reception controller 4 and external wireless module 6 operate on the multiple access principles to communicate with all wireless IC tags 1 in the computer system. BMC 3' and external wireless module 6 are capable of selectively controlling wireless IC tags 1' to obtain status information therefrom by inserting GUIDs of wireless IC tags 1' into data transmitted to wireless IC tags 1'.

FIG. 21 shows in block form wireless IC tag 1' according to the second embodiment. As shown in FIG. 21, wireless IC tag 1' has tag memory 10, power supply 11', tag control circuit 12', transceiver unit 13, tag antenna 14, and error determining unit 15 which are connected to each other by a bus. Tag memory 10 has memory map 100 and stores a threshold which is received from BMC 3' through wireless transmission and reception controller 4 and used for determining an error. Power supply 11' has a cell as described above and supplies electric energy to the other parts of wireless IC tag 1'.

Tag control circuit 12' controls signals and data in wireless IC tag 1'. Tag control circuit 12 also periodically issues a signal for requesting status signal 21 from component control device 20 to acquire status information of component unit 2. Transceiver unit 13 controls signals and data that are input and output through tag antenna 14, and also controls status signal 21 supplied from component control device 20. Transceiver unit 13 also modulates and demodulates signals and data that are input and output through tag antenna 14.

Error determining unit 15 analyzes status signal 21 received from component control device 20 using the threshold stored in tag memory 10 to determine whether component unit 2 is suffering a fault or not.

Figure 22:
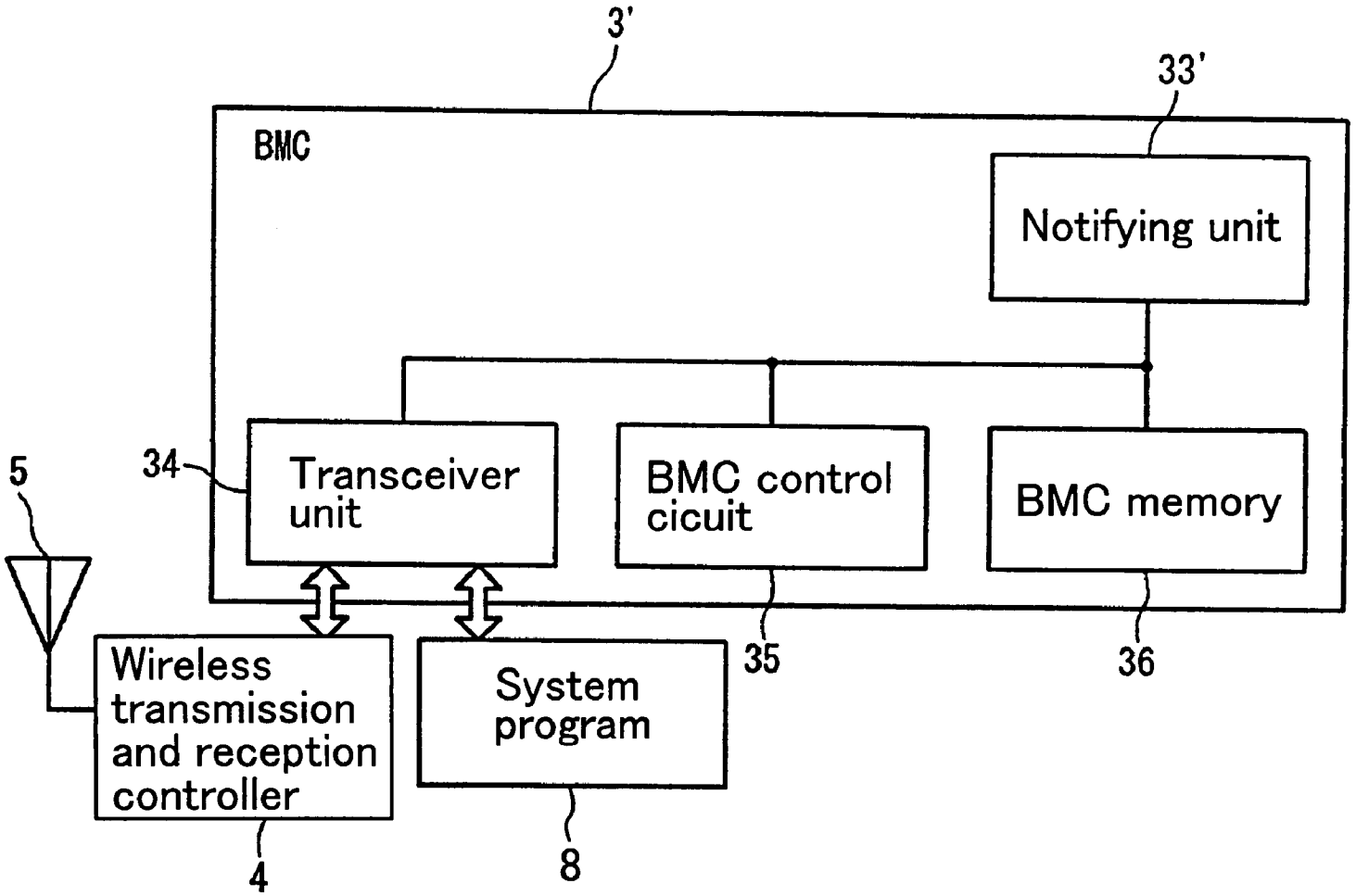
FIG. 22 is a block diagram of a BMC according to the second embodiment of the present invention.

FIG. 22 shows in block form BMC 3' according to the second embodiment. As shown in FIG. 22, BMC 3' has notifying unit 33', transceiver unit 34, BMC control circuit 35, and BMC memory 36 which are connected to each other by a communication bus. Transceiver unit 34 is connected to wireless transmission and reception controller 4 through motherboard 2-4. Transceiver unit 34 controls wireless transmission and reception controller 4 to communicate with wireless IC tags 1' and external wireless module 6 through antenna 5. BMC 3' is controlled by a program such as an OS of the computer system through motherboard 2-4.

BMC control circuit 35 controls signals and data in BMC 3' and also controls operation of notifying unit 33. Transceiver unit 34 controls various signals and data that are input and output between wireless transmission and reception controller 4 and system program 8.

Wireless IC tags 1' are mounted on component units 2 as shown in FIGS. 4 and 5, and acquire status signal 21.

External wireless module 6 is of an arrangement which is identical to the arrangement of external wireless module 6 according to the first embodiment.

Acquisition of Fault Information:

Operation of the component unit monitoring system according to the first embodiment for acquiring fault information will be described below with reference to FIGS. 7, 23 through 26.

Figure 23:
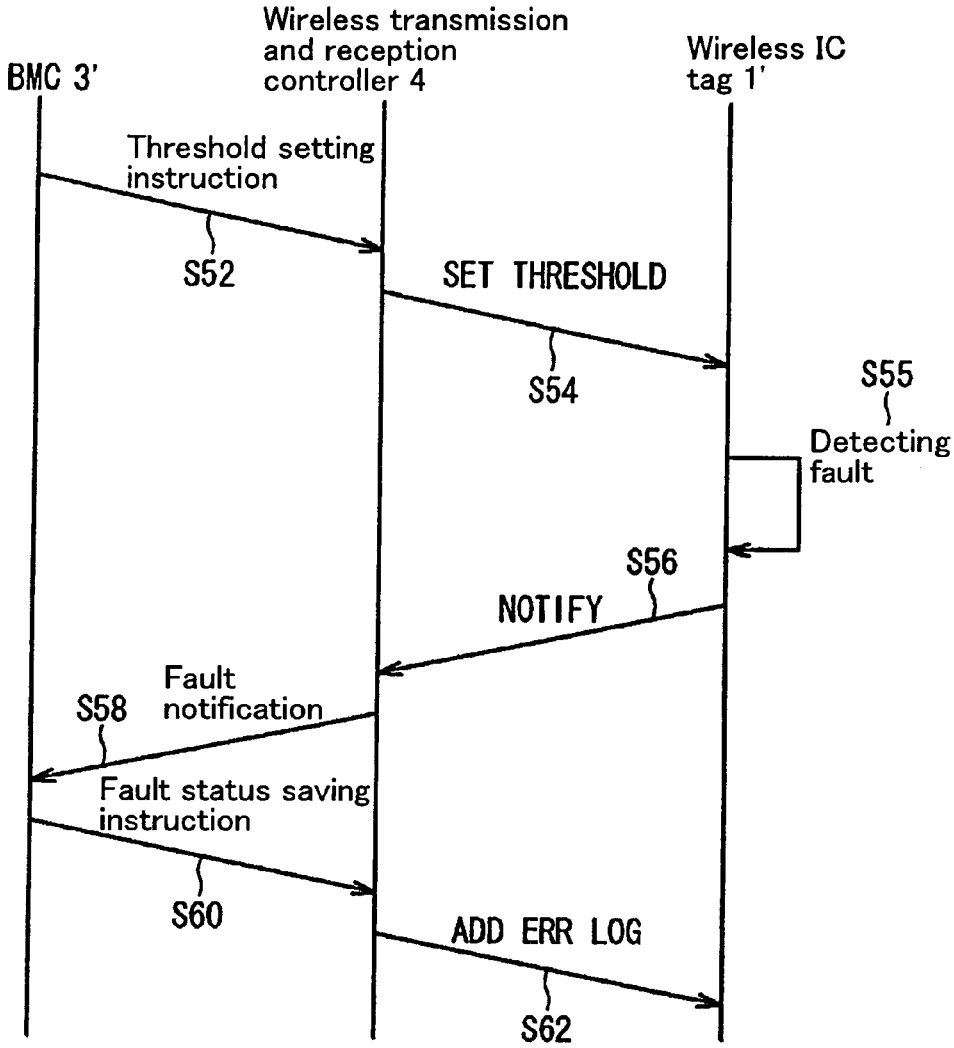
FIG. 23 is a sequence diagram of a sequence for detecting fault information of a component unit according to the second embodiment of the present invention.
Figure 24:
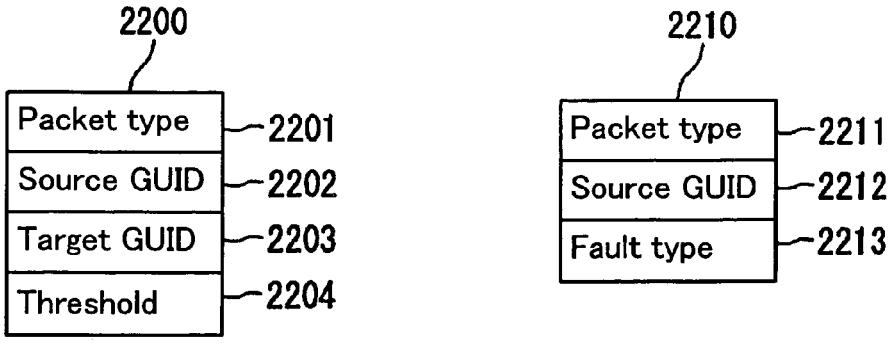
FIG. 24 is a diagram showing the formats of wireless packets used in the fault information detecting process according to the second embodiment of the present invention.

FIG. 23 shows a sequence for detecting fault information of component unit 2 connected to the computer system, and FIG. 24 shows the formats of wireless packets used in the fault information detecting process.

BMC control circuit 35 of BMC 3' issues a threshold setting instruction for setting a threshold used to determine a fault of each component unit 2 in each wireless IC tag 1', to wireless transmission and reception controller 4 in step S52 shown in FIG. 23. In response to the threshold setting instruction from BMC control circuit 35, wireless transmission and reception controller 4 sends SET_THRESHOLD packet 2200 (see FIG. 24) to wireless IC tags 1' that are located within the wireless communication range of the computer system in step S54. SET_THRESHOLD packet 2200 includes packet type 2201, source GUID 2202 representing BMC 3', target GUID 2203 representing wireless IC tag 1' mounted on component unit 2, and threshold 2204 read from BMC memory 36.

When error determining unit 15 of wireless IC tag 1' receives SET_THRESHOLD packet 2200, error determining unit 15 saves threshold 2204 in received SET_THRESHOLD packet 2200 into tag memory 10. Error determining unit 15 also compares saved threshold 2204 with status value 121 stored in tag memory 10 to determine whether component unit 2 is suffering a fault or not. If it is judged that component unit 2 is suffering a fault in step S55, then error determining unit 15 sends NOTIFY packet 2210 including packet type 2211, source GUID 2212, and fault type 2213 representing the type of the fault through wireless link 7 to wireless transmission and reception controller 4 in step S56.

When wireless transmission and reception controller 4 receives NOTIFY packet 2210, wireless transmission and reception controller 4 sends received NOTIFY packet 2210 as a fault notification to BMC 3' in step S58. In response to the fault notification, BMC 3' issues a fault information saving instruction for saving fault information to wireless transmission and reception controller 4 in step S60. In response to the fault information saving instruction, wireless transmission and reception controller 4 sends an ADD_ERR_LOG packet to wireless IC tag 1' in step S62. When wireless IC tag 1' receives the ADD_ERR_LOG packet, wireless IC tag 1' saves analyzed fault information acquired from component unit 2 in association with a fault detection time in tag memory 10.

Figure 25:
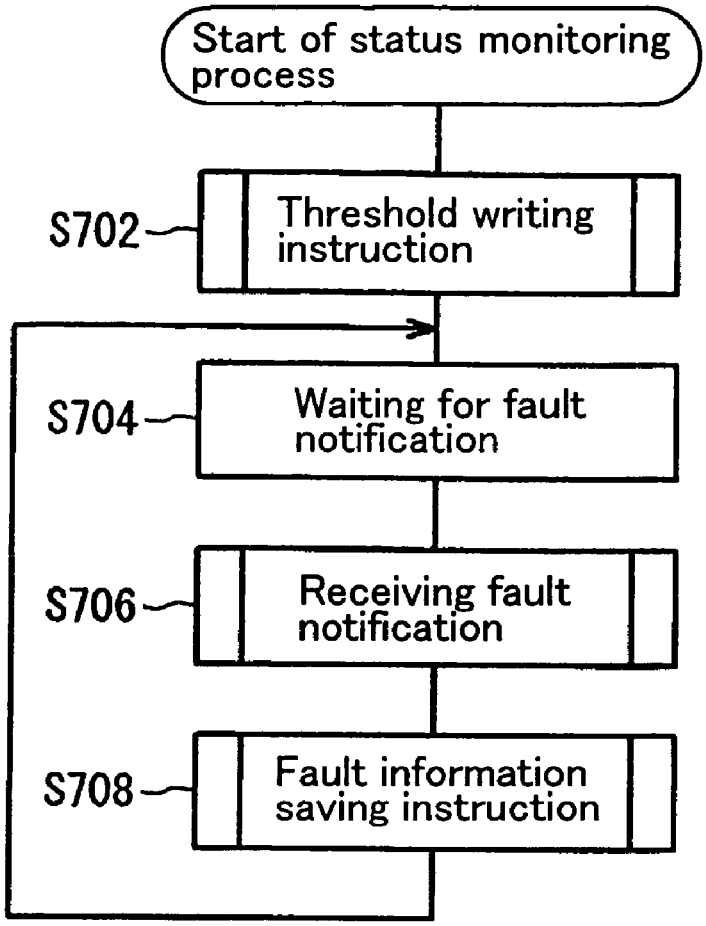
FIG. 25 is a flowchart of a process performed by a BMC for monitoring fault information according to the second embodiment of the present invention.

FIG. 25 shows a process performed by BMC 3' for monitoring fault information according to the second embodiment. When BMC 3' issues a threshold setting instruction for writing a threshold used to determine a fault of each component unit 2 in each wireless IC tag 1', to wireless transmission and reception controller 4, wireless transmission and reception controller 4 sends SET_THRESHOLD packet 2200 to each wireless IC tag 1' in step S702. BMC 3' waits for a fault notification from wireless IC tags 1' that are being monitored, i.e., that are located within the range of wireless links 7 in the same computer system, in step S704. When BMC 3' receives NOTIFY packet 2210 from wireless IC tag 1' in step S706, BMC 3' issues a fault information saving instruction to wireless IC tag 1' represented by a target GUID which is indicated by source GUID 2212 included in NOTIFY packet 2210 in step S708. After having issued the fault information saving instruction, BMC 3' waits for a fault notification again.

Figure 26:
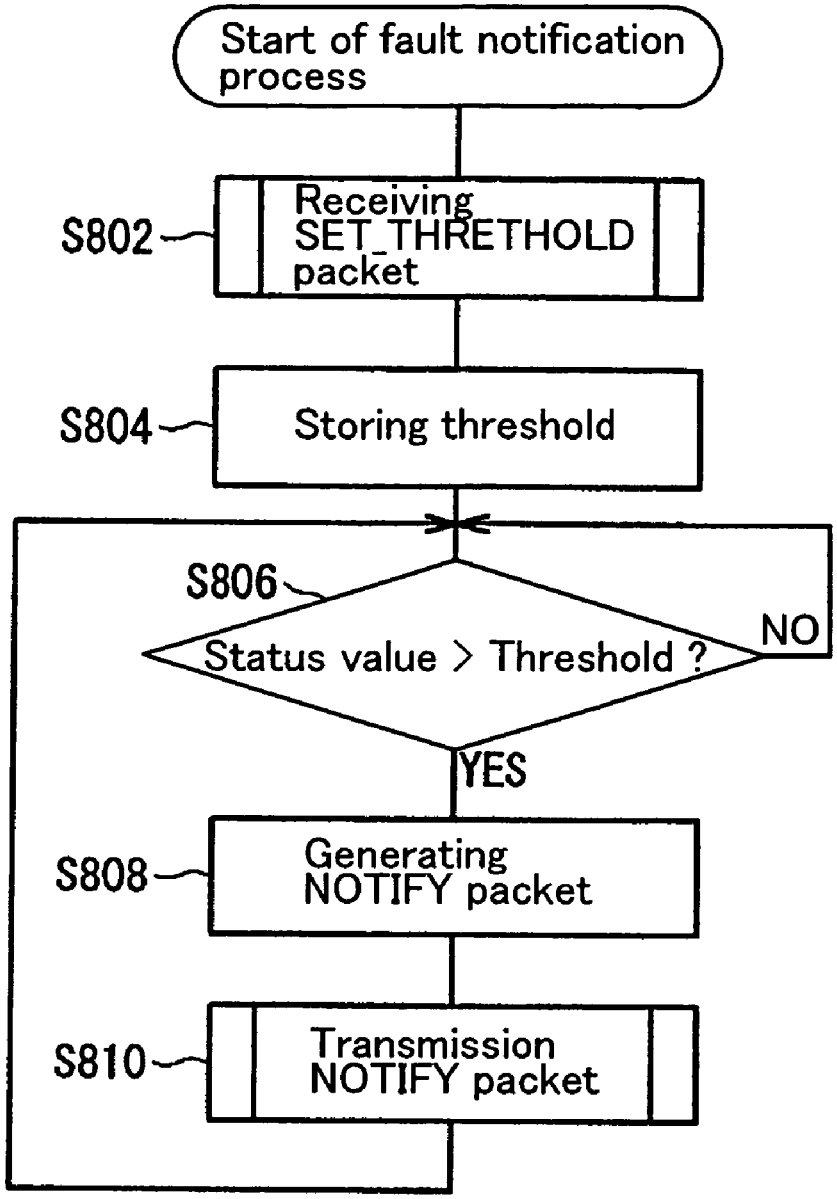
FIG. 26 is a flowchart of a fault information notifying process performed by the wireless IC tag according to the second embodiment of the present invention.

FIG. 26 shows a fault information notifying process performed by wireless IC tag 1' according to the second embodiment. Error determining unit 15 of wireless IC tag 1' receives SET_THRESHOLD packet 2200 in step S802 and stores the threshold in SET_THRESHOLD packet 2200 into tag memory 10 in step S804. Tag control circuit 12' periodically receives status signal 21 from component control device 20, and sends the acquired status value to error determining unit 15. Error determining unit 15 compares the status value from tag control circuit 12' with the threshold in tag memory 10. If the status value exceeds the threshold in tag memory 160, then error determining unit 15 judges that component unit 2 is suffering an error, i.e., a fault (YES in step S806). When error determining unit 15 judges that component unit 2 is suffering an error, error determining unit 15 generates NOTIFY packet 2210 including fault type 2213 in step S808, and sends generated NOTIFY packet 2210 through wireless link 7 to BMC 3' in step S810. As described above, error determining unit 15 periodically analyzes the status value acquired from component unit 2, and stores fault information which is obtained as a result of the analysis in association with the detection time into tag memory 10 according to a fault information saving instruction from BMC 3'.

According to the second embodiment, as described above, when each active wireless IC tag 1' detects a fault on its own, active wireless IC tag 1' transmits fault information to BMC 3' and stores the fault information as a fault history. Consequently, the component unit monitoring system according to the second embodiment is not required to perform the polling process that is necessary in the component unit monitoring system according to the first embodiment.

As with the component unit monitoring system according to the first embodiment, the component unit monitoring system according to the second embodiment allows external wireless module 6 to acquire fault information from each wireless IC tag 1' through wireless link 7. Therefore, it is possible to grasp whether component unit 2 is suffering a fault or not regardless of whether the computer system is turned on or off.

3rd Embodiment

A component unit monitoring system according to a third embodiment of the present invention is similar to either one of the component unit monitoring systems according to the first and second embodiments except that the component unit monitoring system employs single wireless IC tag 1 mounted on component unit 2 and connected to the computer system, and single wireless IC tag 1 stores a fault information history. The fault information history is recorded in the same manner as with the component unit monitoring systems according to the first and second embodiments. Therefore, a faulty component can be identified and analyzed regardless of whether the computer system is turned on or off.

4th Embodiment

A component unit monitoring system according to a fourth embodiment of the present invention is similar to either one of the component unit monitoring systems according to the first, second, and third embodiments except that it has wireless transmission and reception controller 4' connected in common to BMCs 3 of a plurality of computer systems, instead of wireless transmission and reception controller 4, and operates in the same manner as with the component unit monitoring systems according to the first, second, and third embodiments. According to the fourth embodiment, wireless transmission and reception controllers are not installed in association with respective servers, e.g., blade servers, accommodated in a rack mount system, but single wireless transmission and reception controller 4' is disposed in the rack mount system. Single wireless transmission and reception controller 4' is capable of detecting all wireless IC tags that are involved. The component unit monitoring system with the single wireless transmission and reception controller is relatively simple in structure and can monitor component units at a reduced cost.

The present invention is not limited to the details of the illustrated embodiments, but many changes and modifications may be made therein without departing from the scope of the invention. For example, according to the first and second embodiments, the data of the fields of response packets (EXIST, STATUS) from wireless IC tags are generated by extracting some values stored in memory map 100 of tag memory 10. However, the data of the fields of response packets may be generated by extracting all the values stored in memory map 100 for simplifying the processing in the wireless IC tags.

In component unit monitoring systems according to the first through fourth embodiments, the information stored in the wireless IC tags and communication packets that are exchanged through wireless links 7 may be encrypted against unauthorized access from third parties.

The accumulated running time of each of the component units may be stored in the corresponding wireless IC tag. The timing for replacement of the component unit combined with the wireless IC tag may then be judged based on the accumulated running time stored in the wireless IC tag.

The accumulated running time thus stored is particularly useful for managing consumable products such as FANs, HDDs, etc.

Furthermore, information representing the shipment date and sold date of each of the component units may also be stored in the corresponding wireless IC tag. Based on the stored information representing the shipment date and sold date, it can be determined whether the component unit is still under guarantee or not. The information thus stored is particularly useful for managing products having certain guarantee periods.

In the above embodiments, component units to be monitored are included in a computer system. However, component units to be monitored may be external devices such as portable USB memories. If an external device is to be monitored, then a wireless IC tag is mounted on the external product for managing information of the external device.

If a component unit monitoring system monitors external devices, then an installation history and a file transfer history may be stored in a wireless IC tag mounted on each of the external devices, and the component unit monitoring system may have a function to inhibit external devices free of wireless IC tags from being used. The component unit monitoring system thus arranged may be combined with a security check system in a building for checking unauthorized attempts to take classified data out of the building based on the information stored in wireless IC tags mounted on external devices.

While preferred embodiments of the present invention have been described using specific terms, such description is for illustrative purposes only, and it is to be understood that changes and variations may be made without departing from the spirit or scope of the following claims.

What is claimed is:

1. A component unit monitoring system comprising:

at least one independently installable component unit;

a system management controller;

a wireless transmission and reception controller connected to said system management controller, for controlling communications between said system management controller and a first wireless link; and a wireless IC tag mounted on said component unit, for acquiring status information of said component unit;

wherein said wireless IC tag is connected to said wireless transmission and reception controller through said first wireless link for sending said status information through said first wireless link to said system management controller;

said system management controller analyzes the status information received from said wireless IC tag and sends an analytic result through said first wireless link to said wireless IC tag; and said wireless IC tag stores the analytic result received from said system management controller as a history of chronological data.

2. A component unit monitoring system according to claim 1, wherein said system management controller and said wireless IC tag are energizable by respective different power supplies.

3. A component unit monitoring system according to claim 1, further comprising:

a component control device connected between said component unit and said wireless IC tag;

wherein said system management controller sends a first request signal for acquiring the status information of said component unit to said wireless IC tag through said first wireless link;

said wireless IC tag sends a second request signal to said component control device in response to said first request signal;

said component control device acquires said status information from said component unit in response to said second request signal and sends said status information to said wireless IC tag; and said wireless IC tag sends the status information received from said component control device to said system management controller.

4. A component unit monitoring system according to claim 1, further comprising:

a component control device connected between said component unit and said wireless IC tag;

wherein said component control device periodically acquires said status information from said component unit and sends said status information to said wireless IC tag; and said wireless IC tag periodically sends the status information received from said component control device to said system management controller.

5. A component unit monitoring system according to claim 1, wherein said status information includes component information representing a type of said component unit, and said system management controller holds said component information received from said wireless IC tag in association with an identifier of said component unit as configurational information.

6. A component unit monitoring system according to claim 5, further comprising:

an external wireless module for acquiring said configurational information from said system management controller through a second wireless link.

7. A component unit monitoring system according to claim 6, wherein said external wireless module is connected to said wireless IC tag through said second wireless link for acquiring said history of chronological data from said wireless IC tag.

8. A component unit monitoring system according to claim 1, wherein said history of chronological data comprises an installation history of chronological information regarding a system to which said component unit was connected;

said status information includes said installation history;

said system management controller refers to said installation history, and, if said component unit is newly connected to said system, sends system information representing said system to said wireless IC tag; and said wireless IC tag updates said installation history based on said system information.

9. A component unit monitoring system according to claim 1, wherein said history of chronological data comprises a fault history of chronological fault information of said component unit;

said status information includes a status value representing a status of said component unit;

said system management controller holds a threshold for determining whether said component unit is suffering a fault or not, compares said status value received from said wireless IC tag with said threshold, and, if it is judged that said component unit is suffering a fault from a comparison result, sends fault information to said wireless IC tag; and said wireless IC tag updates said fault history based on said fault information.

10. A method of monitoring a component unit in a system having at least one independently installable component unit, a wireless IC tag mounted on said component unit, and a system management controller for communicating with said wireless IC tag through a first wireless link, comprising (a) controlling said wireless IC tag to acquire status information of said component unit and send the acquired status information to said system management controller through said first wireless link;

(b) controlling said system management controller to analyze the status information received from said wireless IC tag and return an analytic result through said first wireless link to said wireless IC tag; and (c) controlling said wireless IC tag to store the analytic result returned from said system management controller as a history of chronological data.

11. A method according to claim 10, wherein said step (a) is carried out in response to a first request signal received from said system management controller through said first wireless link.

12. A method according to claim 10, wherein said step (a) is periodically carried out.

13. A method according to claim 10, further comprising of:

controlling an external wireless module to acquire the status information of said component unit from said system management controller or said wireless IC tag through a second wireless link, and hold or display the acquired status information.

* * * * *